US008534789B2

(12) United States Patent
Sakurada et al.

(10) Patent No.: US 8,534,789 B2
(45) Date of Patent: Sep. 17, 2013

(54) RECORDING APPARATUS AND CONTROL METHOD THEREFOR

(75) Inventors: Yuichi Sakurada, Kanagawa (JP); Nobuyuki Satoh, Kanagawa (JP); Masato Kobayashi, Kanagawa (JP); Arata Suzuki, Kanagawa (JP); Tatsuhiko Okada, Saitama (JP); Daisaku Horikawa, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 160 days.

(21) Appl. No.: 12/805,746

(22) Filed: Aug. 18, 2010

(65) Prior Publication Data

US 2011/0063352 A1 Mar. 17, 2011

(30) Foreign Application Priority Data

Sep. 14, 2009 (JP) ..... 2009-212280

(51) Int. Cl.
*B41J 29/38* (2006.01)

(52) U.S. Cl.
USPC ..... 347/14

(58) Field of Classification Search
USPC ..... 347/14, 15, 19
See application file for complete search history.

(56) References Cited

U.S. PATENT DOCUMENTS

2010/0225693 A1* 9/2010 Sakurada et al. ..... 347/14

FOREIGN PATENT DOCUMENTS

JP 2008-221729 9/2008
JP 2008-229917 10/2008

* cited by examiner

*Primary Examiner* — Laura Martin
(74) *Attorney, Agent, or Firm* — Harness, Dickey & Pierce P.L.C.

(57) ABSTRACT

A disclosed recording apparatus includes a carriage having a recording head including nozzles, a moving unit configured to move the carriage, a platen including plural plate members connected in a carriage traveling direction to support a recording medium, a transferring unit to transfer the recording medium in a direction perpendicular to the carriage traveling direction, a recording control unit to record patterns at predetermined positions to form a carriage traveling direction pattern array plural times in a transferring direction of the transferring unit by changing relative recording times for recording the carriage traveling direction pattern array in forward and backward traveling directions, a determination unit to determine ink ejecting times at the predetermined positions, and a time control unit to linearly interpolate between the determined ink ejecting times at the predetermined positions to control ink ejecting times for intervals between the predetermined positions based on the obtained linear interpolation.

18 Claims, 25 Drawing Sheets

FIG.15

| ADDRESS INFORMATION | ENCODER VALUE FOR TEST PATTERN | EJECTING TIME ADJUSTING VALUE: dly | SLOPE: δ |
|---|---|---|---|
| 1 | dly pos1 | dly1 | δ 1 |
| 2 | dly pos2 | dly2 | δ 2 |
| 3 | dly pos3 | dly3 | δ 3 |
| * | * | * | * |
| * | * | * | * |
| N−1 | dly posN−1 | dlyN−1 | δ N−1 |
| N | dly posN | dlyN | 0 |
| N' | dly posN | dly'N | δ 'N−1 |
| N'−1 | dly posN−1 | dly'N−1 | δ 'N−2 |
| * | * | * | * |
| 4' | dly pos4 | dly'4 | δ '3 |
| 3' | dly pos3 | dly'3 | δ '2 |
| 2' | dly pos2 | dly'2 | δ '1 |
| 1' | dly pos1 | dly'1 | 0 |

| SYMBOL | DESCRIPTION |
|---|---|
| Vcrg | CARRIAGE SPEED |
| Vjet | INK EJECTING SPEED |
| θ | SLOPE OF PLATEN |
| ϕ | INK EJECTING ANGLE |
| hm | CARRIAGE-PLATEN DISTANCE AT ENCODER VALUE xml |
| lm | INK EJECTING DISTANCE AT ENCODER VALUE xml |
| h1 | CARRIAGE-PLATEN DISTANCE AT ENCODER VALUE x1 |
| l1 | INK EJECTING DISTANCE AT ENCODER VALUE x1 |

RECORDING APPARATUS AND CONTROL METHOD THEREFOR

BACKGROUND OF THE INVENTION

1. Field of the Invention

The invention generally relates to a recording apparatus such as an ink-jet printer and a method for controlling the recording apparatus.

2. Description of the Related Art

In a typical inkjet recording apparatus, a recording head attached to a carriage ejects ink onto a recording medium placed on a platen to form a line of an image on the recording medium while reciprocating the carriage in a main-scanning direction (i.e., a carriage traveling direction). Thereafter, the line of the image is repeatedly formed on the recording medium while the recording medium is transferred in a sub-scanning direction (i.e., in a direction perpendicular to the carriage traveling direction) using a transfer roller, to thereby form a complete image on the recording medium. Note that the platen is a supporting member to support the recording medium while the ink is ejected onto the recording medium.

In the inkjet recording apparatus, a relative distance between the platen and the carriage may vary with a position of the carriage in the main-scanning direction due to an assembling error of the carriage, deterioration in sliding bearings of the carriage with aging, and the like. When the relative distance between the platen and the carriage has varied with the position of the carriage in the main-scanning direction, the ink is ejected at positions differing from desired ones (ideal positions) on the recording medium. Thus, it may be difficult to form the image with high resolution and stability.

Note that the above inconsistent distance between the platen and the carriage may also occur when the platen is shifted in the main-scanning direction. Similar to the carriage case, the platen may be shifted in the main-scanning direction due to an assembling error of the platen, aging of the platen, and the like. Further, if the platen is composed of plural plate-like members, the plate-like members may be shifted with different angles in main-scanning directions. If the platen is shifted in the main-scanning direction, or the plate-like members of the platen are shifted with different angles in the main-scanning directions, the relative distance between the platen and the carriage varies with the position of the carriage in the main-scanning direction. As a result, even if the image is formed by reciprocating the carriage that is not tilted in the main-scanning direction, the ink may be ejected at positions differing from desired ones (ideal positions) on the recording medium, which makes it difficult to form the image with high resolution and stability. That is, when the relative distance between the platen and the carriage varies with the position of the carriage in the main-scanning direction, the positions of ink droplets are shifted from the desired ones (ideal positions) on the recording medium. Thus, it may be difficult to form the image with high resolution and stability.

Japanese Patent Application Publication No. 2008-221729 discloses technology for enabling registration adjustment corresponding to an irregularly uneven recording medium in a main-scanning direction of a recording head while forming an image on the recording medium.

With this technology, a user configures a recording apparatus such that test patterns are formed at two or more positions including projected portions and recessed portions of the irregularly uneven recording medium while reciprocating the recording head in the scanning direction. The test patterns are formed at the two or more positions set by the user on the recording medium by printing in forward and backward traveling directions by making the printing time in the backward traveling directions different from the printing time in the forward traveling directions. The registration adjustment corresponding to the printing on the irregularly uneven recording medium in the backward traveling direction is made based on the printing time at which an optimal test pattern is made. Accordingly, the registration adjustment is appropriately made when the irregularly uneven recording medium is used, and ink droplet shifts (i.e., print shifts) on the recording medium obtained while printing in the reciprocating directions may be reduced.

In the disclosed technology, however, the user needs to set the positions on the recording medium at which the test patterns are formed, which may be burdensome for the user.

Moreover, the platen used in the disclosed technology is made as a single unit, and if the platen is made by connecting plural plate-like members in the scanning direction (carriage traveling direction), the print shifts may not be controlled by the disclosed technology.

SUMMARY OF THE INVENTION

It is a general object of at least one embodiment of the present invention to provide a recording apparatus and a method for controlling the recording apparatus that substantially eliminate one or more problems caused by the limitations and disadvantages of the related art. Specifically, the embodiments of the present invention attempt to provide a recording apparatus including a platen composed of plural plate-like members connected in a main-scanning direction (carriage traveling direction) and a method for controlling the recording apparatus capable of controlling ink droplet shifts obtained due to changes in relative distances between the plural plate-like members of the platen and the carriage in the main-scanning direction.

In one embodiment, there is provided a recording apparatus that includes: a carriage having a recording head including plural nozzles for, ejecting ink; a moving unit configured to move the carriage having the recording head including the plural nozzles for ejecting ink; a platen including plural plate members connected in a carriage traveling direction and configured to support a recording medium when the plural nozzles of the carriage eject ink onto the recording medium; a transferring unit configured to transfer the recording medium in a direction perpendicular to the carriage traveling direction; a recording control unit configured to record patterns, the number of which corresponds to a number of the plate members, at predetermined plural positions in the carriage traveling direction on a surface of the recording medium supported by the platen to form a carriage traveling direction pattern array while moving the carriage in forward and backward traveling directions, and record the carriage traveling direction pattern array plural times in a transferring direction of the transferring unit by changing relative recording times for recording the carriage traveling direction pattern array in forward and backward traveling directions to form plural transferring direction pattern arrays in the transferring direction of the transferring unit such that a pattern group including a group of the patterns is obtained; a determination unit configured to determine ink ejecting times at the predetermined plural positions in the carriage traveling direction on a surface of the recording medium by selecting an optimal pattern from each of the plural transferring direction pattern arrays recorded at the predetermined plural positions in the carriage traveling direction on the surface of the recording medium; and a time control unit configured to linearly interpolate between the determined ink ejecting times at the predetermined plural positions in the carriage traveling direction on the surface of the recording medium so as to control ink ejecting times for respective intervals between the predetermined plural positions in the carriage traveling direction on the surface of the recording medium based on the linear interpolation between the determined ink ejecting times at the predetermined plural positions in the carriage traveling direction.

In another embodiment, there is provided a method for controlling a recording apparatus that includes a carriage having a recording head including plural nozzles for ejecting ink, a moving unit configured to move the carriage having the recording head including the plural nozzles for ejecting ink, a platen including plural plate members connected in a carriage traveling direction and configured to support a recording medium when the plural nozzles of the carriage eject ink onto the recording medium, and a transferring unit configured to transfer the recording medium in a direction perpendicular to the carriage traveling direction. The method includes: recording patterns, the number of which corresponds to a number of the plate members, at predetermined plural positions in the carriage traveling direction on a surface of the recording medium supported by the platen to form a carriage traveling direction pattern array while moving the carriage in forward and backward traveling directions, and recording the carriage traveling direction pattern array plural times in a transferring direction of the transferring unit by changing relative recording times for recording the carriage traveling direction pattern array in forward and backward traveling directions to form plural transferring direction pattern arrays in the transferring direction of the transferring unit such that a pattern group including a group of the patterns is obtained; determining ink ejecting times at the predetermined plural positions in the carriage traveling direction on a surface of the recording medium by selecting an optimal pattern from each of the plural transferring direction pattern arrays recorded at the predetermined plural positions in the carriage traveling direction on the surface of the recording medium; and linearly interpolating between the determined ink ejecting times at the predetermined plural positions in the carriage traveling direction on the surface of the recording medium so as to control ink ejecting times for respective intervals between the predetermined plural positions in the carriage traveling direction on the surface of the recording medium based on the linear interpolation between the determined ink ejecting times at the predetermined plural positions in the carriage traveling direction.

BRIEF DESCRIPTION OF THE DRAWINGS

Other objects and further features of embodiments will be apparent from the following detailed description when read in conjunction with the accompanying drawings, in which:

FIG. 15 is a configuration diagram illustrating a correspondence table referred to by a calculator circuit 6;

DESCRIPTION OF THE PREFERRED EMBODIMENTS

Outline of Recording Apparatus

In the following, embodiments of the present invention will be described with reference to FIGS. 2 through 4, and FIGS. 7 through 10.

Figure 19:
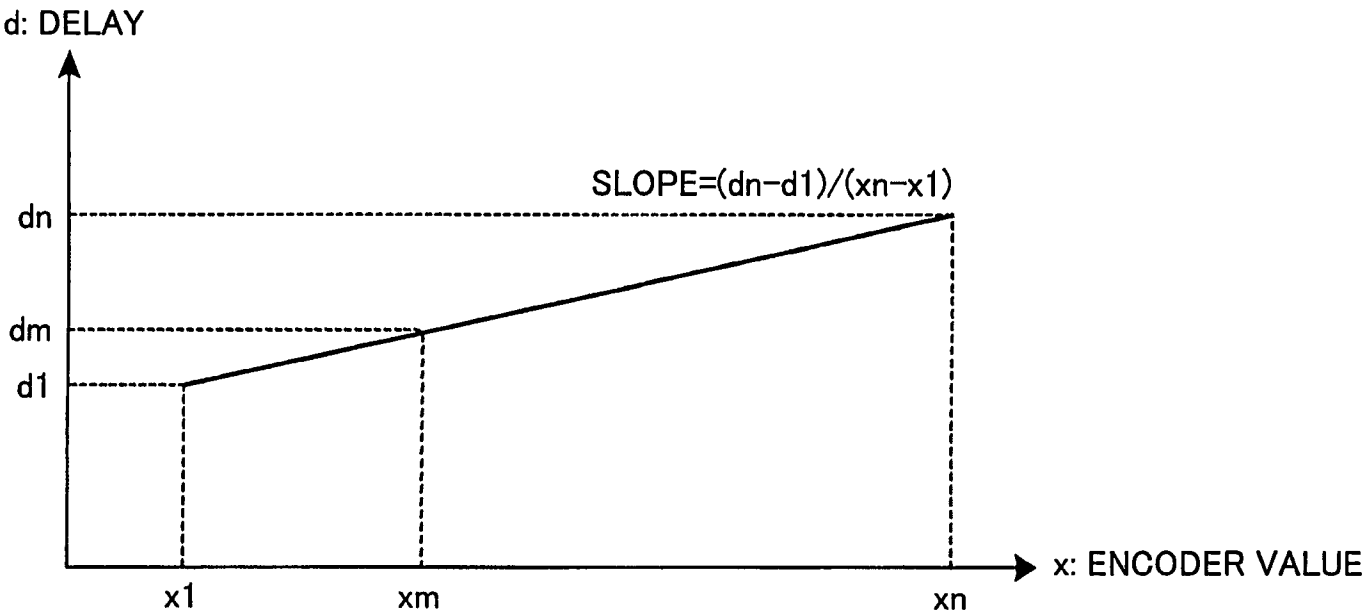
FIG. 19 is a fourth diagram illustrating a process in which shifts in inkjet printing are reduced.

As illustrated in FIGS. 2 through 4, and FIG. 9, a recording apparatus according to the embodiments of the invention includes a carriage 5 having a recording head 6 composed of plural nozzles for ejecting ink, a moving unit (i.e., a CPU 107 and a main-scanning driver 109 in FIG. 9) configured to move the carriage 5, a platen 200 configured to support a recording medium 16 onto which ink is ejected from the nozzles, the platen 200 formed of plural plate-like members connected in a carriage traveling direction, and a transferring unit (i.e., the CPU 107, a sub-scanning driver 113, and a paper feed unit 112 in FIG. 19) configured to transfer the recording medium 16 in a direction perpendicular to the carriage traveling direction.

Figure 7:
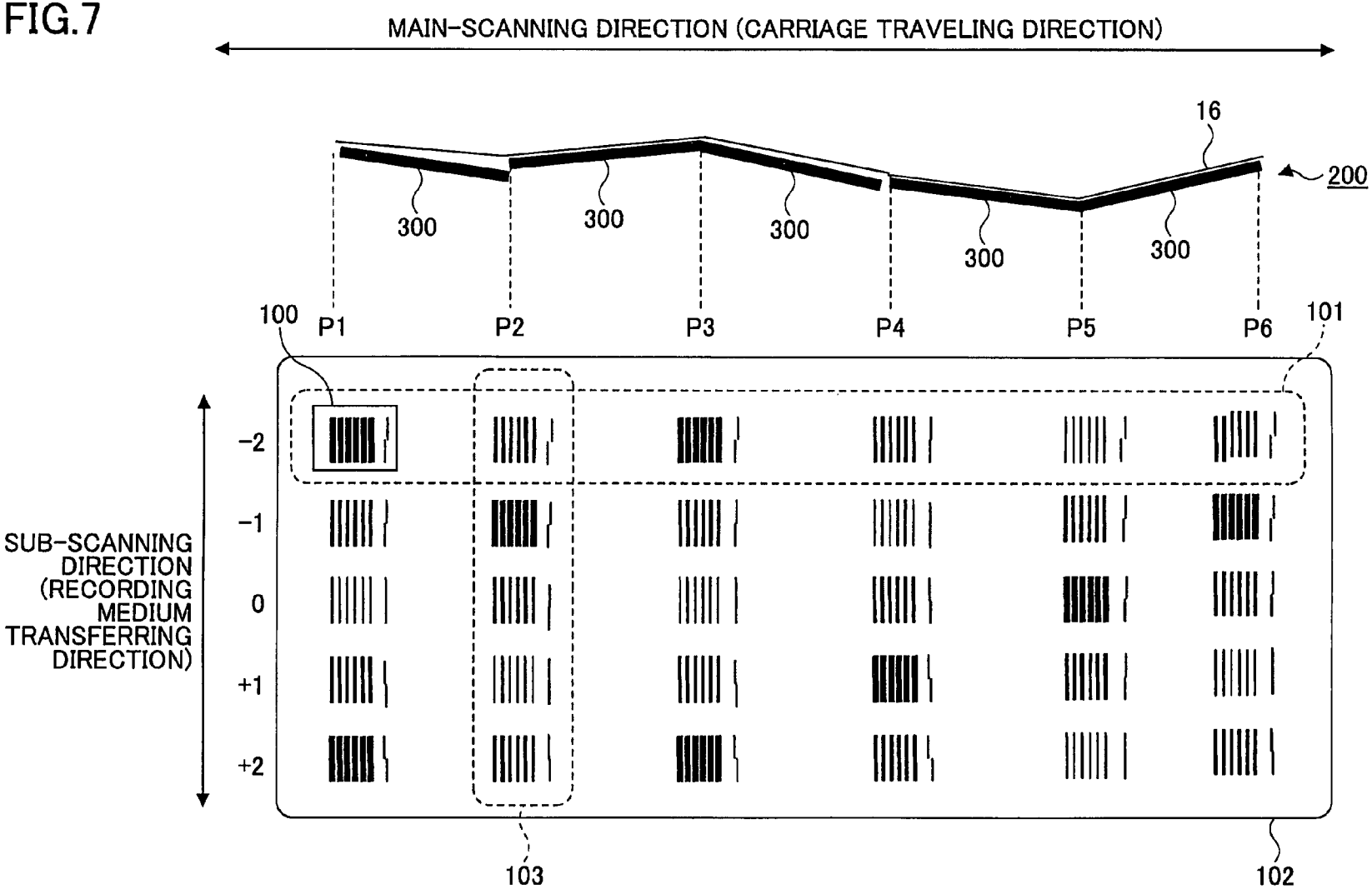
FIG. 7 is a third diagram illustrating an example of the recording method of the test patterns 100.

As illustrated in FIG. 7, the recording apparatus according to the embodiments records test patterns 100, the number of which corresponds to the number of plate-like members 300, at predetermined positions P1 to P6 in the carriage traveling direction while reciprocating the carriage 5 in the carriage traveling direction, thereby forming a carriage traveling direction pattern array 101. The recording apparatus then repeatedly records the carriage traveling direction pattern array 101 in a transferring direction of the transferring unit (i.e., a sub-scanning direction) by relatively altering a recording time for each of the reciprocating operations, thereby forming a pattern group 102 composed of a group of the patterns 100. This processing is indicated by step A1 in FIG. 10.

Next, in the pattern group 102 composed of arrays of the plural patterns 100 in the transferring directions at the predetermined positions P1 through P6, the optimal pattern 100 is selected from each of plural transferring direction pattern arrays 103. Accordingly, the ink ejecting times at the predetermined positions P1 through P6 are determined. This processing is indicated by steps A2 and A3 in FIG. 10.

Subsequently, ink ejecting times at respective intervals between the predetermined positions P1 through P6 are controlled based on a result obtained by linearly interpolating the determined ejecting times at the predetermined positions P1 through P6. This processing is indicated by steps A4 and A5 in FIG. 10.

Accordingly, in the recording apparatus according to the embodiments including the platen 200 composed of the plural plate-like members 300 connected in the main-scanning direction (carriage traveling direction), it is possible to reduce the ink droplet shifts obtained due to the changes in relative distances between the plural plate-like members 300 of the platen 200 and the carriage 5 in the main-scanning direction. A detailed description is given below, with reference to the accompanying drawings.

First Embodiment

Schematic Configuration Example of Mechanical Unit of Recording Apparatus

Figure 1:
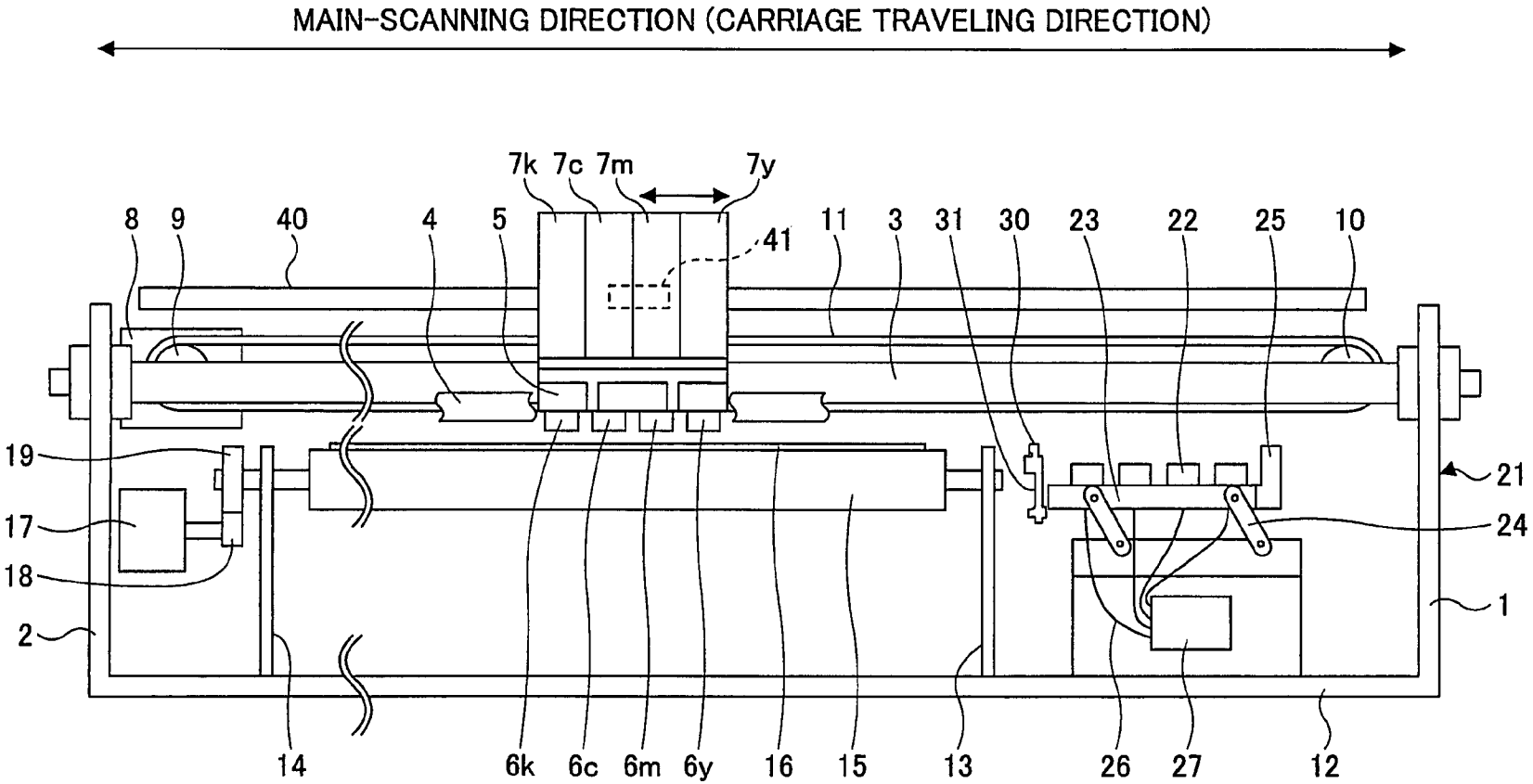
FIG. 1 is a schematic configuration diagram illustrating a mechanical unit of a recording apparatus according to an embodiment.

Referring to FIG. 1, a schematic configuration example of a mechanical unit of the recording apparatus according to a first embodiment is described.

The recording apparatus according to the first embodiment includes side plates 1 and 2, a main supporting guide rod 3 and sub-supporting guide rods 4 arranged in an approximately horizontal position between the side plates 1 and 2, and a carriage 5 slidably supported by the main supporting guide rod 3 and the sub-supporting guide rods 4 in a main-scanning direction.

The carriage 5 includes four recording heads 6*y*, 6*m*, 6*c*, and 6*k* having respective downwardly directed ejecting faces (nozzle faces) for ejecting yellow (Y) ink, magenta (M) ink, cyanogen (C) ink, and black (K) ink. The carriage 5 further includes four replaceable ink cartridges 7 (reference numeral "7" indicates one of 7*y*, 7*m*, 7*c*, and 7*k*, or their generic term) above the respective recording heads 6 (hereinafter, reference numeral "6" indicates one of 6*y*, 6*m*, 6*c*, and 6*k*, or their generic term). The ink cartridges 7 are used as ink suppliers to supply ink of respective color to the four recording heads. The carriage 5 is connected to a timing belt 11 looped over a driving pulley (driving timing pulley) 9 rotated by a main-scanning motor 8 and a driven pulley (idler pulley) 10, such that the carriage 5 is driven controlled in the main-scanning direction by the main-scanning motor 8. The carriage 5 includes an encoder sensor 41 configured to detect a mark on an encoder sheet 40 and to obtain an encoder value based on the detected mark. The carriage 5 travels in the main-scanning direction based on the obtained encoder value.

The recording apparatus according to the first embodiment further includes a bottom plate 12 connecting the side plates 1 and 2, sub-frames 13 and 14 on the bottom plate 12, and a transferring roller 15 rotationally supported between the sub-frames 13 and 14. The recording apparatus according to the first embodiment further includes a sub-scanning motor 17 on the sub-frame 14 side, and a first gear 18 fixed on a rotational shaft of the sub-scanning motor 17 and a second gear fixed on a shaft of the transferring roller 15, thereby transmitting rotations of the transferring roller of the sub-scanning motor 17.

The recording apparatus according to the first embodiment further includes a reliability maintenance recovery mechanism (hereinafter referred to as a "sub-system") 21 for the recording heads 6 located between the side plate 1 and the sub-frame 13. The sub-system 21 includes four caps 22 to cap the ejecting faces of the recording heads 6, a holder 23 to support the caps 22, and link members 24 to reciprocally support the holder 23. If the carriage 5 is moved in the main-scanning direction to abut on an engaging portion 25 on the holder 23, the holder 23 is lifted up so that the caps 22 cap the respective ejecting faces of the recording heads 6. Further, if the carriage 5 is moved to a print region side, the holder 23 is lifted down such that the caps 22 are detected from the ejecting faces of the recording heads 6.

Note that the caps 22 are connected to a suction pump 27 via respective suction tubes 26, and the caps 22 also include respective air release holes configured to communicate with an ambient atmosphere air via air release tubes and an air release valve. The suction pump 27 discharges suctioned waste liquid (ink) in a waste liquid depot.

Note also that a wiper blade 30 for wiping the ejecting faces of the recording heads 6 is attached to a blade arm provided on a side of the holder 23. The blade arm 31 is movably supported by the holder 23 such that the blade arm 31 is moved by rotations of a cam driven by a not-shown driving unit.

[Configuration Example of Printing Mechanism of Recording Device]

Figure 2:
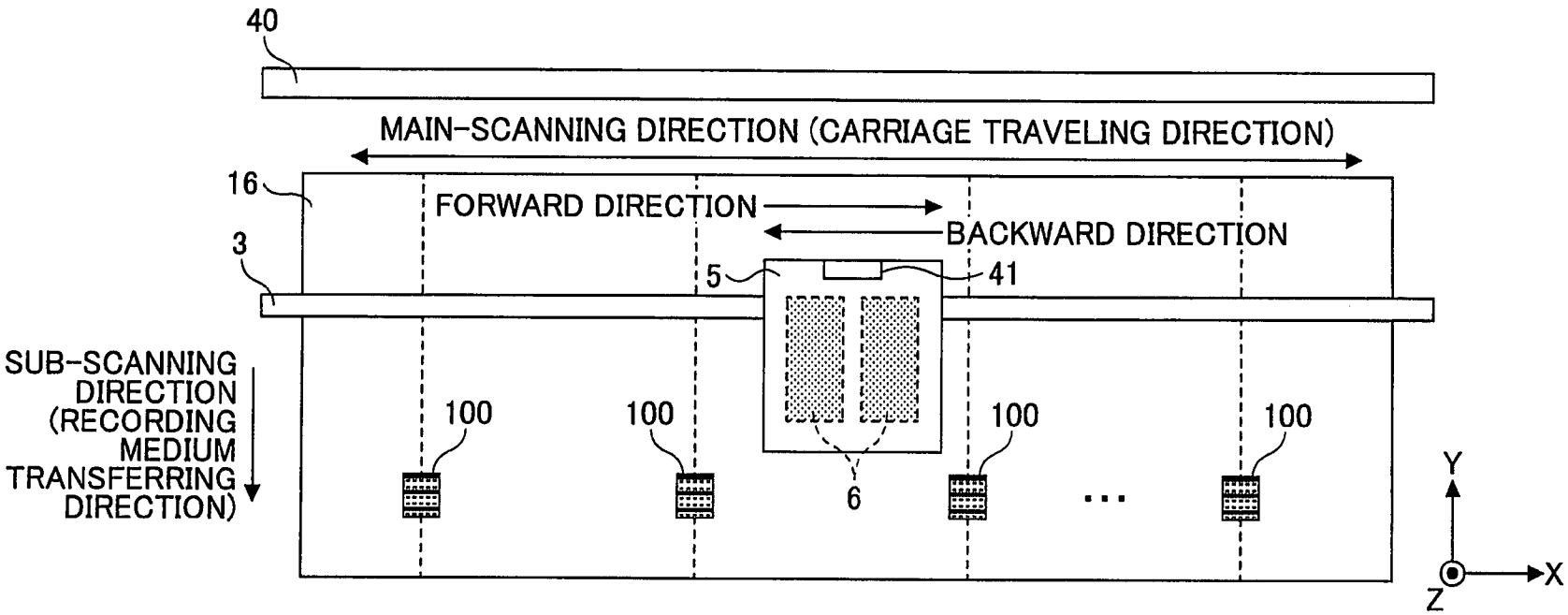
FIG. 2 is a first schematic configuration diagram illustrating a printing mechanism of the recording apparatus according to the embodiment.
Figure 3:
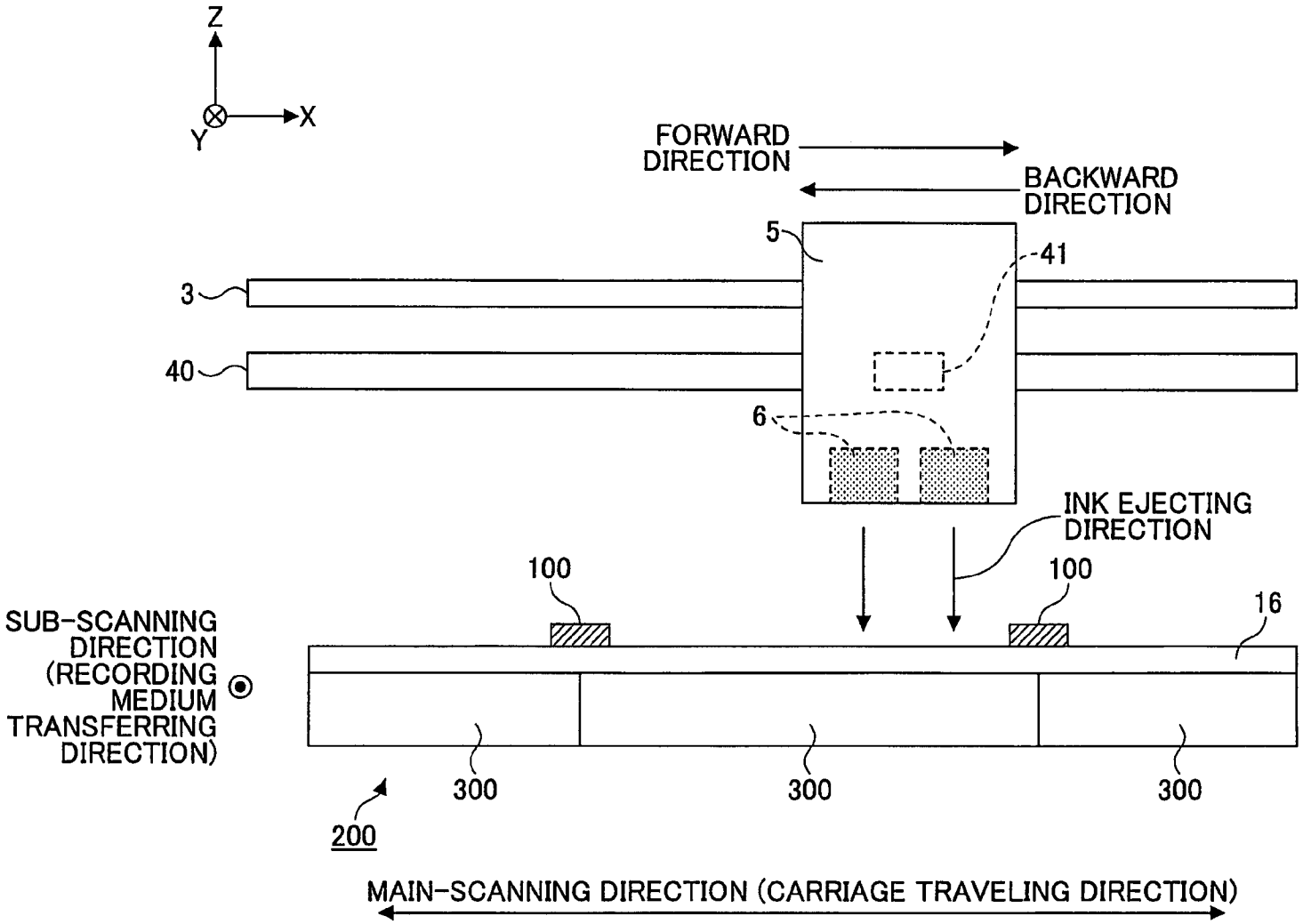
FIG. 3 is a second schematic configuration diagram illustrating the printing mechanism of the recording apparatus according to the embodiment.
Figure 4:
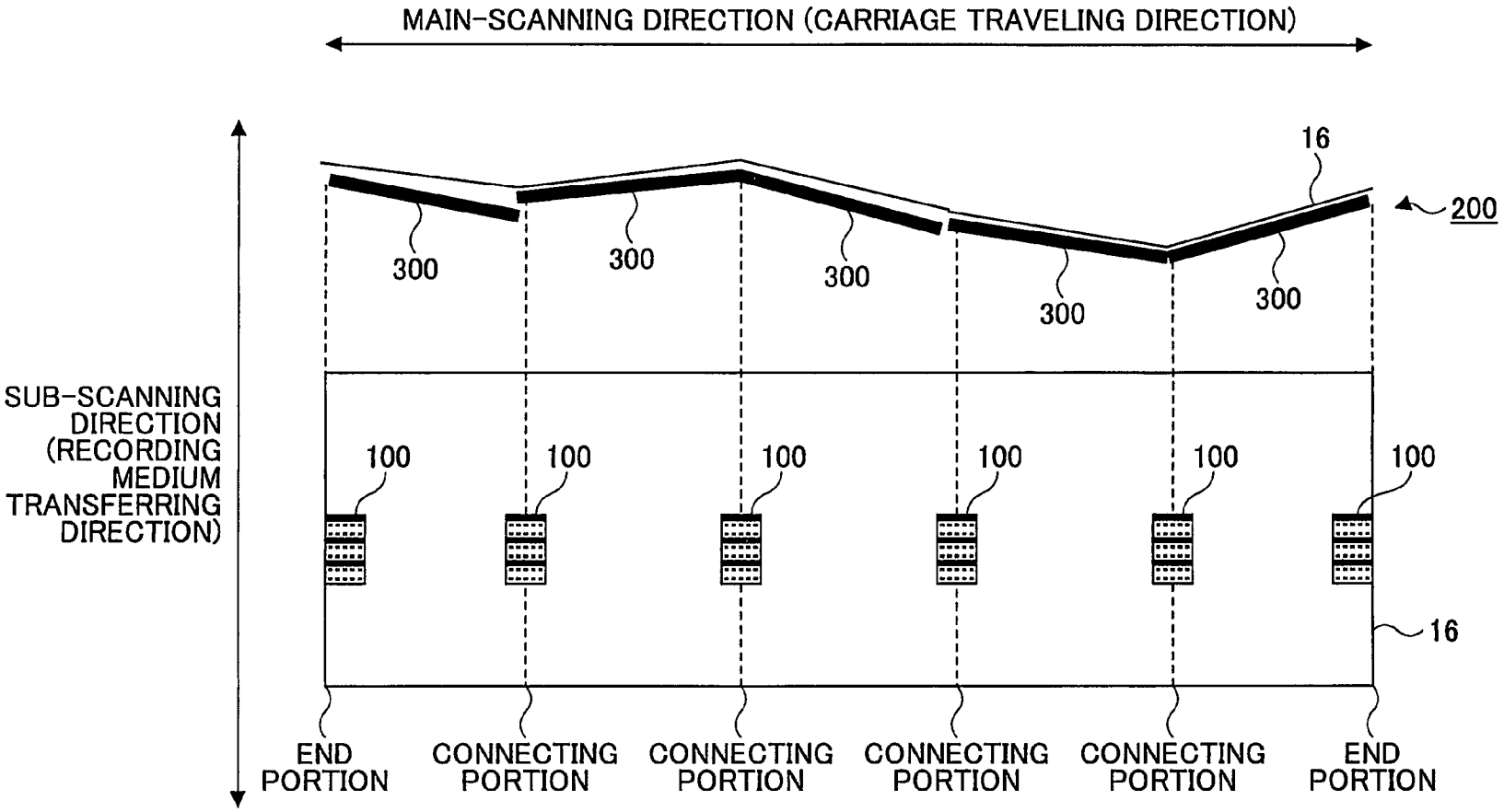
FIG. 4 is a configuration diagram illustrating a platen 200 and test patterns 100.

Next, a configuration example of a printing mechanism of the recording apparatus according to the first embodiment is described with reference to FIGS. 2 through 4. FIG. 2 is a top view of the carriage 5, FIG. 3 is a side view of the carriage 5, and FIG. 4 is a diagram illustrating a configuration example of the platen 200 and the test patterns 100.

The printing mechanism of the recording apparatus according to the first embodiment includes the carriage 5, the main supporting guide rod 3, the encoder sheet 40, and the platen 200. The carriage 5 includes the recording heads 6 and the encoder sensor 41.

The platen 200 is a supporting member to support the recording medium 16 while the ink is ejected onto the recording medium 16. The recording apparatus according to the first embodiment has a large width so that the carriage 5 can travel a long scanning travel distance in the main-scanning direction. Accordingly, the platen 200 is composed of the plural plate-like members 300 mutually connected in the main-scanning direction (i.e., carriage traveling direction) as illustrated in FIG. 4. If the platen 200 is composed of one large member, the platen 200 composed of one large member may result in low profile irregularity, or the cost of making the platen 200 with one large member may be high. Note that the platen 200 used in the first embodiment includes five mutually connected plate-like members 300.

The recording head 6 includes the plural nozzle arrays configured to eject ink onto the recording medium 16 that is transferred on the platen 200, thereby printing an image composed of dots on the recording medium 16. The printing mechanism according to the first embodiment moves the carriage 5 having the recording heads 6 in the main-scanning direction, and causes the nozzle arrays of the recording heads 6 to eject ink onto the recording medium 16 placed on the platen 200, thereby recording the test patterns 100 on the recording medium 16.

As illustrated in FIG. 4, the test patterns 100 are recorded at the positions of the recording medium 16 corresponding to both end portions of the platen 200 and connecting portions of the plate-like members 300 connected in the main-scanning direction. Accordingly, the number of test patterns 100 recorded on the recording medium 16 corresponds to the number of plate-like members 300 forming the platen 200. If the number of plate-like members 300 forming the platen 200 is supposed to be N, the number of test patterns 100 to be recorded on the recording medium 16 is obtained by (N−1)+2. In FIG, 4, since five plate-like members 300 are connected to form the platen 200, the number of connecting portions is four, and the number of end portions of the platen 200 is 2. Accordingly, there are a total number of 6 positions on the recording medium 16 at which the test patterns 100 are to be recorded. That is, the number of test patterns 100 is obtained by (5−1)+2, resulting in 6.

Thus, since the recording apparatus according to the first embodiment is configured to record the test patterns 100, the number of which corresponds to the number of plate-like members 300 forming the platen 200, in the main-scanning direction (i.e., carriage traveling direction), a user may not have to set the positions on the recording medium 16 at which the test patterns 100 are to be recorded.

[Example of Test Pattern Recording Method]

Next, an example of a test pattern recording method is described with reference to FIGS. 5 through 7.

Figure 5:
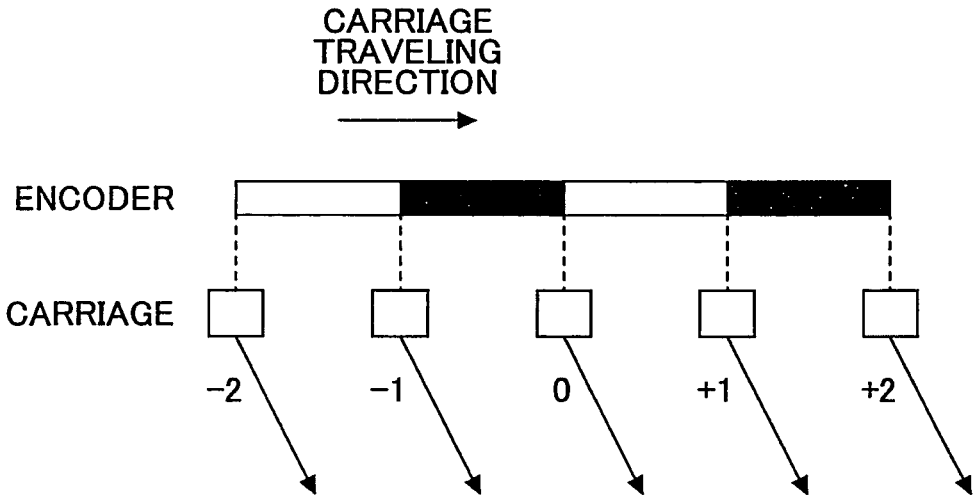
FIG. 5 is a first diagram illustrating an example of a recording method of test patterns 100.
Figure 6:
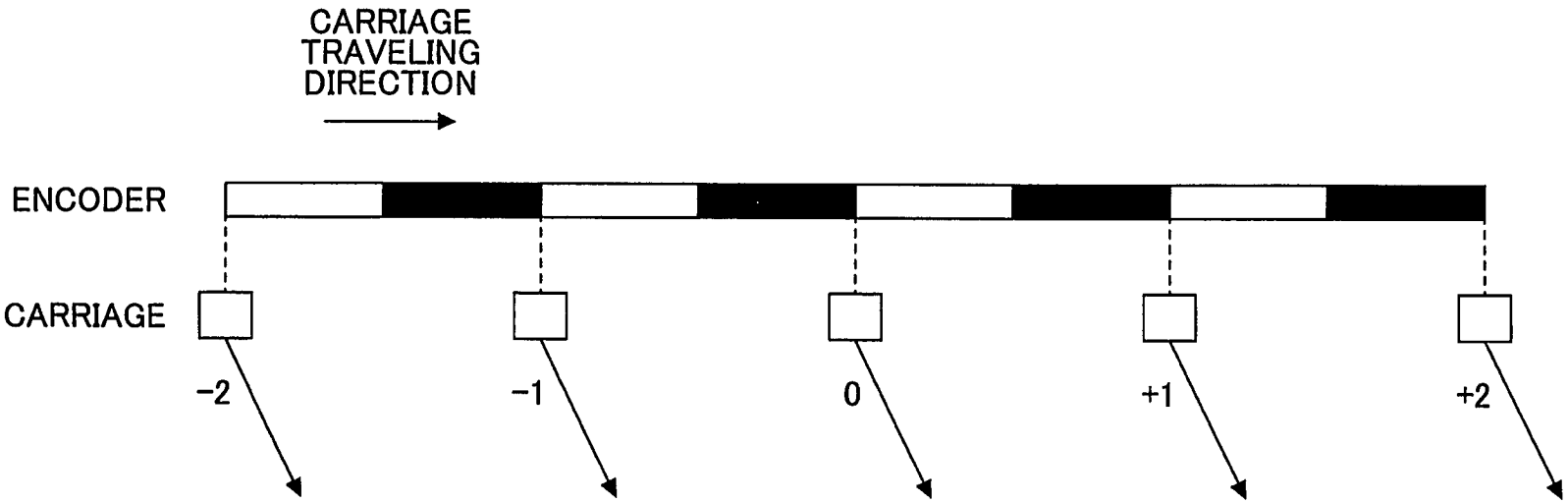
FIG. 6 is a second diagram illustrating an example of the recording method of the test patterns 100.

As illustrated in FIG. 5, when recording the test patterns 100, a position of an encoder value is 0, from which ½ encoder values that are shifted are +1 and −1 positions. FIG. 5 illustrates printing times obtained by shifting a cycle of the encoder by a ¼ cycle. However, the printing times are not limited to those shifted by ¼ cycle as illustrated in FIG. 5. As illustrated in FIG. 6, the printing times may be obtained by shifting the cycle of the encoder by a longer cycle than the ¼ cycle. By contrast, the printing times may be obtained by shifting the cycle of the encoder by a shorter cycle than the ¼ cycle (not shown).

As illustrated in FIG. 7, with the recording apparatus according to the first embodiment, the test patterns 100 are recorded at the positions of the recording medium 16 corresponding to both end portions P1 and P6 of the platen 200 and connecting portions P2 through P5 of the plate-like members 300. The resolution of the encoder is 300 dpi, and vertical lines (pattern) forming each of the test patterns 100 is obtained by printing 600 dpi one dot lines at one dot intervals.

With the first scan (i.e., first forward traveling), forward traveling marks are printed at a fixed time (e.g., one of −2 to +2 positions in FIG. 5), thereby recording a forward traveling mark array in the main-scanning direction.

With the second scan (i.e., first backward traveling), backward traveling marks are printed at −2 position, thereby recording a backward traveling mark array in the main-scanning direction.

Accordingly, the test patterns 100 composed of the forward traveling marks and the backward traveling marks are recorded at predetermined positions of the recording medium 16 corresponding to both end portions P1 and P6 of the platen 200 and connecting portions P2 through P5 of the plate-like members 300 in the carriage traveling direction, so that the first carriage traveling direction pattern array 101 is recorded on the recording medium 16. Note that one test pattern 100 is composed of the forward traveling marks and the backward traveling marks, and the carriage traveling direction pattern array 101 is composed of the forward traveling mark arrays and the backward traveling arrays.

Next, the recording medium 16 is transferred for the third scan (i.e., second forward traveling), where forward traveling marks are printed at the same fixed time as the first scan, thereby recording a forward traveling mark array in the main-scanning direction.

With the fourth scan (i.e., second backward traveling), backward traveling marks are printed at −1 position, thereby recording a backward traveling mark array in the main-scanning direction.

Accordingly, the test patterns 100 composed of the forward traveling marks and the backward traveling marks are recorded at the predetermined positions of the recording medium 16 corresponding to both end portions P1 and P6 of the platen 200 and connecting portions P2 through P5 of the plate-like members 300 in the carriage traveling direction, so that the second carriage traveling direction pattern array 101 is recorded on the recording medium 16.

Thereafter, in the odd-number scans, the forward traveling marks are printed at the same fixed time as the first scan to record a forward traveling mark array in the main-scanning direction, whereas in the even-number scans, the backward traveling marks are printed by shifting a position from 0 via +1 to +2 to record a backward traveling mark array in the main-scanning direction. As a result, the plural carriage traveling direction pattern arrays 101 are recorded in the sub-scanning direction to form a pattern group 102 composed of a group of the test patterns 100.

Accordingly, the recording apparatus according to the first embodiment records the test patterns 100, the number of which corresponds to the number of plate-like members 300, at the predetermined positions P1 to P6 in the carriage traveling direction while reciprocating the carriage 5, thereby forming a carriage traveling direction pattern array 101. The recording apparatus then repeatedly records the carriage traveling direction pattern array 101 in the sub-scanning direction by relatively altering a recording time for each of the reciprocating operations, thereby forming the pattern group 102 composed of a group of the test patterns 100.

There are no print shifts if the backward traveling marks printed in the backward traveling are overlapped with the forward traveling marks in the forward traveling and hence the test pattern 100 composed of a group of fine lines is formed on the recording medium 16. The example of FIG. 7 illustrates the respective test patterns 100 having no print shifts obtained at 0 for P1, +1 for P2, 0 for P3, −1 for P4, +2 for P5, and +1 for P6.

Note that the test pattern 100 at −2 for P5 also seems to have no print shifts. However, one dot is shifted in the one dot line in this case. Accordingly, the test pattern 100 at −2 for P5 results in having a print shift.

Figure 8:
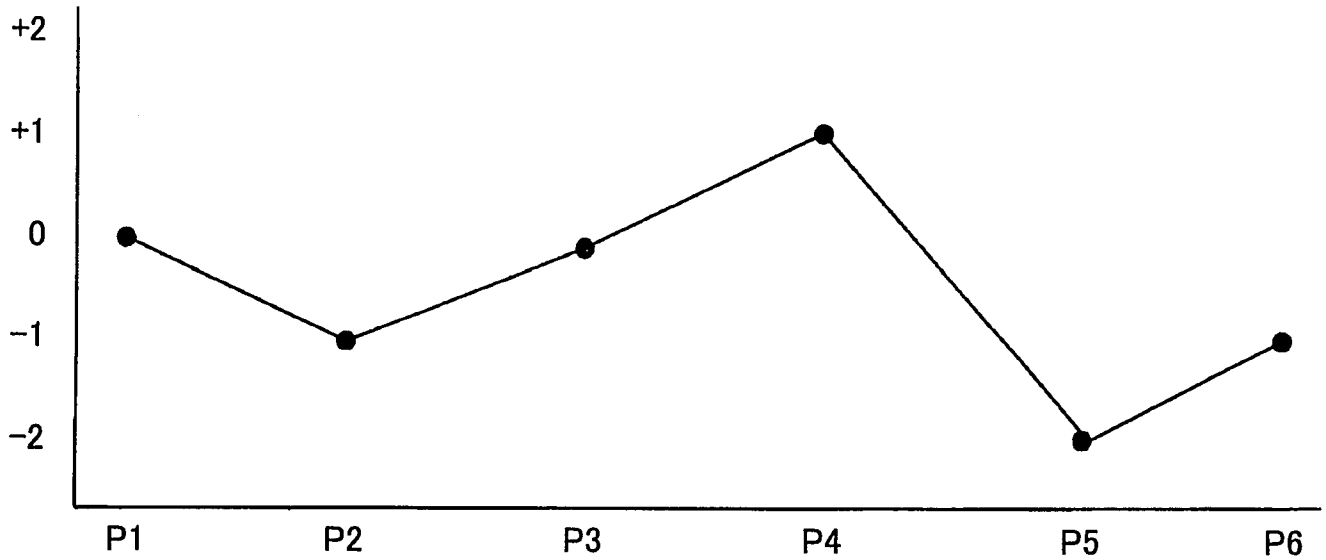
FIG. 8 is a diagram illustrating an ejecting time adjusting value obtained based on the test patterns 100.

In the first embodiment, the optimal test pattern 100 having no print shifts may be selected from each of the transferring direction pattern arrays 103 composed of the plural test patterns 100 arranged in the sub-scanning direction by the user's observation of the group of fine lines and the one dot lines composing the test pattern 100 with the naked eye. Accordingly, an optimal ink ejecting time adjusting value at a position where the optimal test pattern 100 is to be recorded may be determined based on the optimal test pattern 100 selected by the user. The optimal ink ejecting time adjusting value is determined for each of the test patterns 100 recorded at the positions P1 through P6 in the main-scanning direction. In this manner, the optimal ink ejecting time adjusting values may be obtained for the positions P1 through P6 where the test patterns 100 are recorded in the main-scanning direction as illustrated in FIG. 8.

The ink ejecting time for the backward traveling may be obtained by linearly changing the ink ejecting time adjusting value for each of the intervals between two adjacent points of P1 to P6 to control the ink ejecting time based on the linearly changed ink ejecting time adjusting value. Accordingly, the print shifts may be reduced in the entire main-scanning direction. Note that the ink ejecting time for the backward traveling is the same as the one already described.

[Configuration Example of Control Mechanism of Recording Device]

Figure 9:
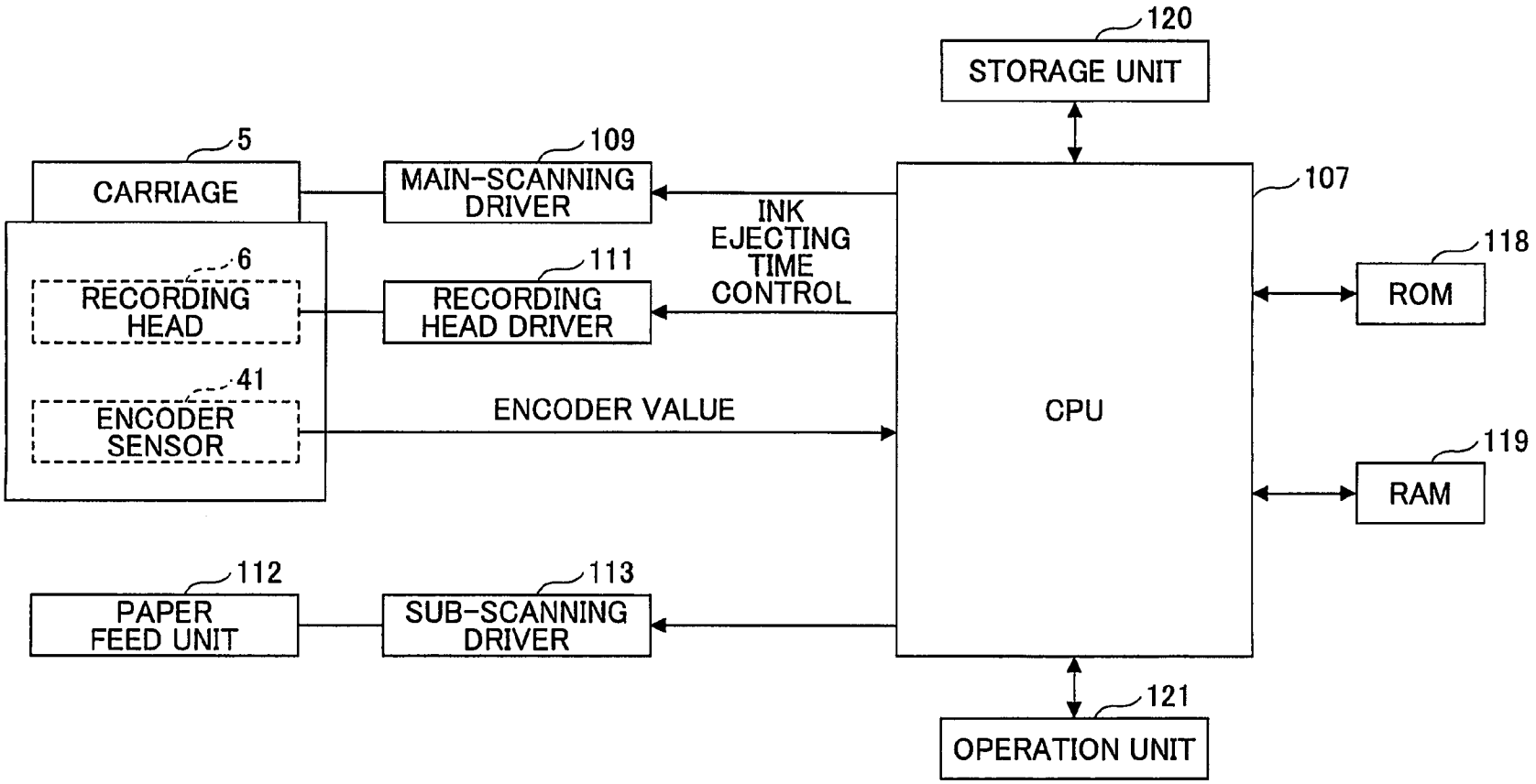
FIG. 9 is a configuration diagram illustrating a control mechanism of the recording apparatus according to the embodiment.

Next, a configuration example of a control mechanism of the recording apparatus according to the first embodiment is described with reference to FIG. 9.

The control mechanism of the recording apparatus according to the first embodiment includes a CPU 107, a ROM 118, a RAM 119, a storage unit 120, an operation unit 121, the carriage 5, the main-scanning driver 109, the recording head 6, a recording head driver 111, the encoder sensor 41, the paper feed unit 112, and the sub-scanning driver 113.

The CPU 107 supplies recording data or driving control signals (pulse signals) to the storage unit 120 and the respective drivers, thereby controlling the entire recording apparatus. The CPU 107 controls the driving of the carriage 5 in the main-scanning direction via the main-scanning driver 109. The CPU 107 also controls the ink ejecting time for the recording head via the recording head driver 111. The CPU 107 also controls the driving of the paper feed unit 112 (e.g., a transfer belt) in the sub-scanning direction via the sub-scanning driver 113.

The operation unit 121 is configured to set the optimal test pattern 100 selected by the user from the transferring direction pattern array 103 illustrated in FIG. 7. The optimal test pattern 100 is set for the positions P1 through P6 where the test patterns 100 are recorded in the main-scanning direction. In this manner, the CPU 107 obtains the optimal ink ejecting time adjusting values for the positions P1 through P6 where the test patterns 100 are recorded in the main-scanning direction as illustrated in FIG. 8. The CPU 107 adjusts the ink ejecting time for the recording head 6 based on the optimal ink ejecting time adjusting values for the positions P1 through P6.

The encoder sensor 41 detects an encoder mark to output an encoder value obtained based on the mark on the encoder sheet 40 to the CPU 107. The CPU 107 controls the driving of the carriage 5 in the main-scanning direction via the main-scanning driver 109 based on the obtained encoder value.

The ROM 118 is configured to store desired information. For example, the ROM 118 stores computer programs such as processing instructions to be executed by the CPU 107. The RAM 119 is used as a working memory or the like.

[Ejecting Time Adjusting Method]

Figure 10:
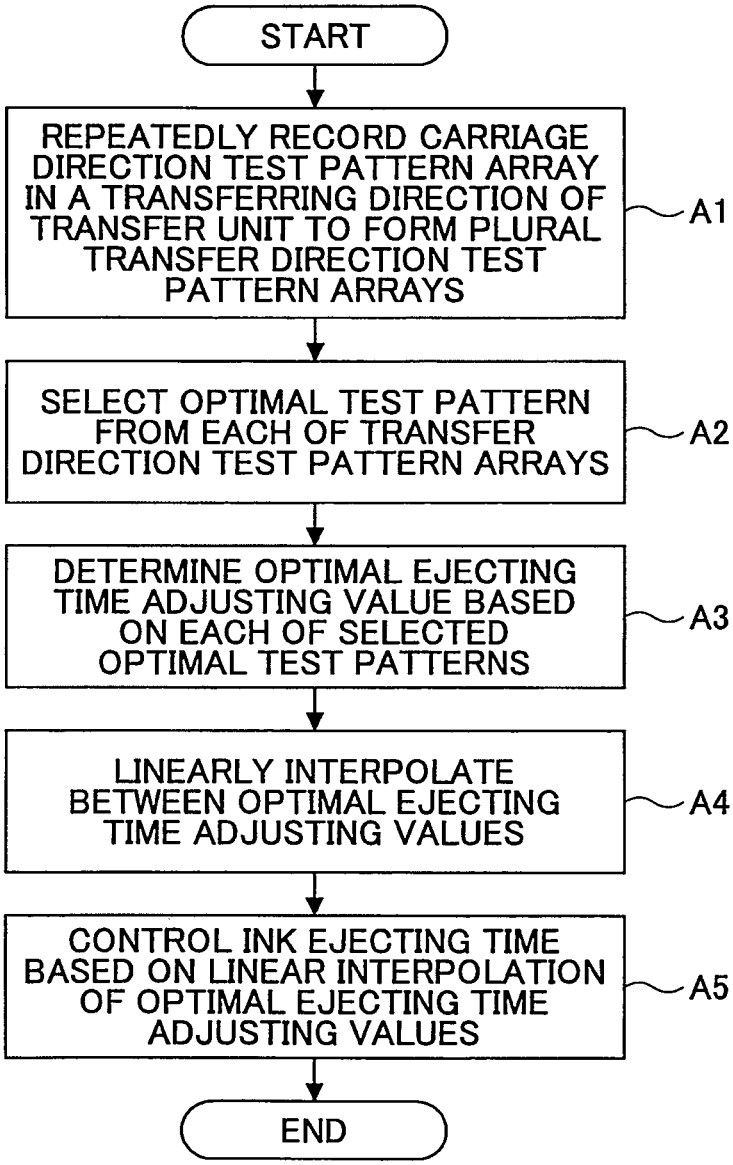
FIG. 10 is a diagram illustrating an example of processing of the recording apparatus according to the embodiment.

Next, an ink ejecting time adjusting method according to the first embodiment is described with reference to FIG. 10.

The CPU 107 controls the driving of the carriage 5 such that the test patterns 100, the number of which correspond to the number of plate-like members 300 forming the platen, are recorded at the predetermined positions P1 through P6 in the carriage traveling direction, thereby obtaining the carriage traveling direction pattern array 101. Note that the test pattern 100 is composed of the forward traveling marks printed in the forward traveling of the carriage 5 and the backward traveling marks printed in the backward traveling of the carriage 5, and the carriage traveling direction pattern array 101 is composed of the number of the test patterns 100 recorded at the predetermined positions P1 through P6 in the carriage traveling direction corresponding to the number of the plate-like members 300. The CPU 107 controls the driving of the carriage 5 to relatively move the printing positions of the forward traveling marks printed in the forward traveling of the carriage 5 and the printing positions of the backward traveling marks printed in the backward traveling of the carriage 5, so that the plural carriage traveling direction patterns 101 are recorded in the sub-scanning direction (recording medium transferring direction). Accordingly, the pattern group 102 composed of a group of the test patterns 100 may be obtained (step A1). Thus, as illustrated in FIG. 7, the test patterns 100, the number of which corresponds to the number of the plate-like members 300, are recorded at the predetermined positions P1 through P6 in the carriage traveling direction.

The user selects the optimal test pattern 100 having no print shifts from each of the transferring direction pattern arrays 103 composed of the plural test patterns 100 arranged in the sub-scanning directions by observing each of the transferring direction pattern arrays 103 composed of the plural test patterns 100 arranged in the sub-scanning directions with the naked eye (step A2). The user selects the optimal test pattern 100 from the test patterns 100 recorded at each of the positions P1 through P6 in the main-scanning direction. The user sets optimal test pattern information via the operation unit 12.

The CPU 107 determines the optimal ink ejecting time adjusting values for the positions P1 through P6 where the test patterns 100 are recorded in the main-scanning direction based on the optimal test pattern information set by the user via the operation unit 121 (step A3).

In this manner, the CPU 107 determines the optimal ink ejecting time adjusting values for the positions P1 through P6 where the test patterns 100 are recorded in the main-scanning direction as illustrated in FIG. 8.

The CPU 107 linearly interpolates between the optimal ink ejecting time adjusting values illustrated in FIG. 8 and computes an ejecting time for each of the intervals between two adjacent points of P1 through P6 based on the linear interpolation between the optimal ink ejecting time adjusting values (A4).

The CPU 107 controls the ink ejecting time for the recording head 6 based on the ejecting time for each of the intervals between two adjacent points of P1 through P6 based on the linear interpolation between the optimal ink ejecting time adjusting values (step A5).

[Recording Head Ejecting Time Adjusting Method]

Figure 11A:
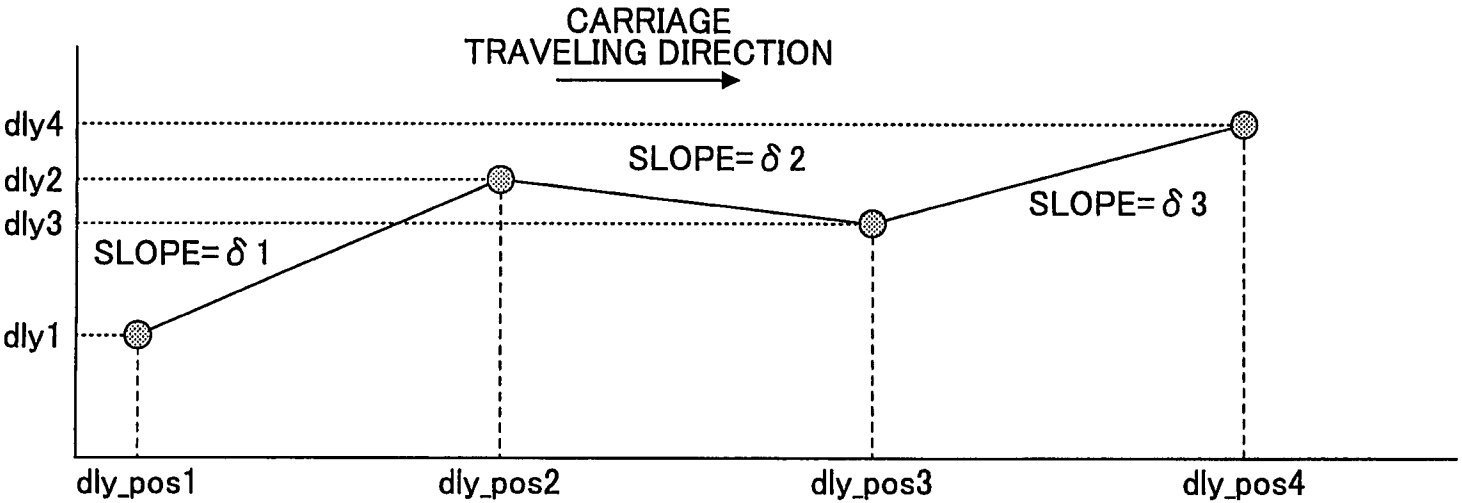
FIGS. 11A and 11B are diagrams illustrating a relationship between encoder values (dly_pos1 to dly_pos4) of the test patterns 100 and ejecting time adjusting values (dly1 to dly4, dly'4 to dly'1)
Figure 11B:
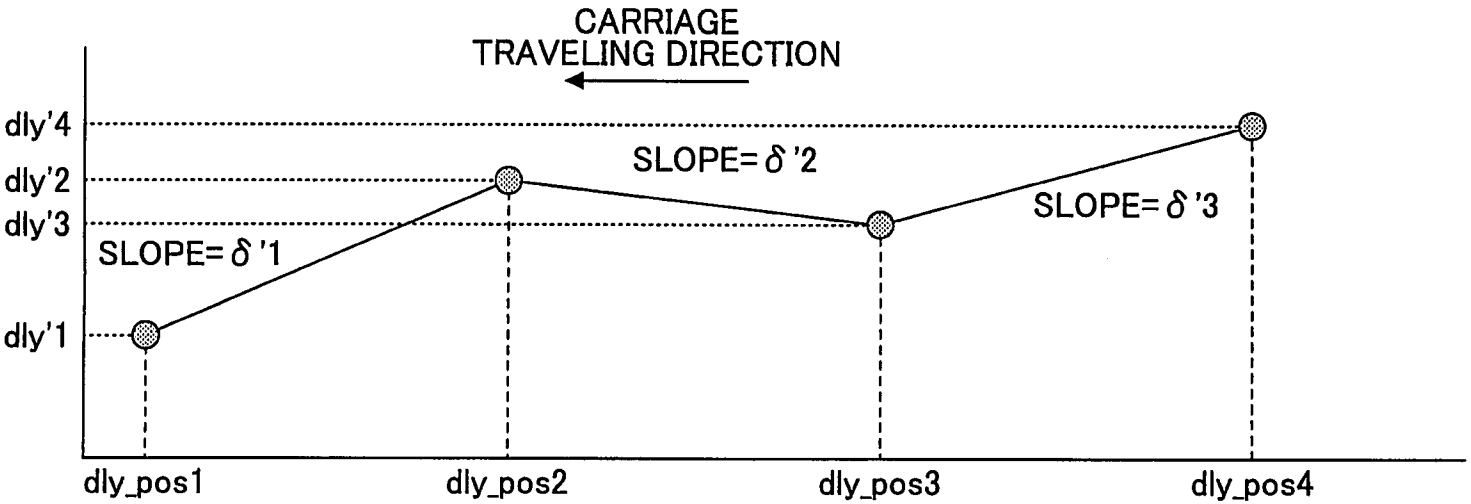
Figure 12A:
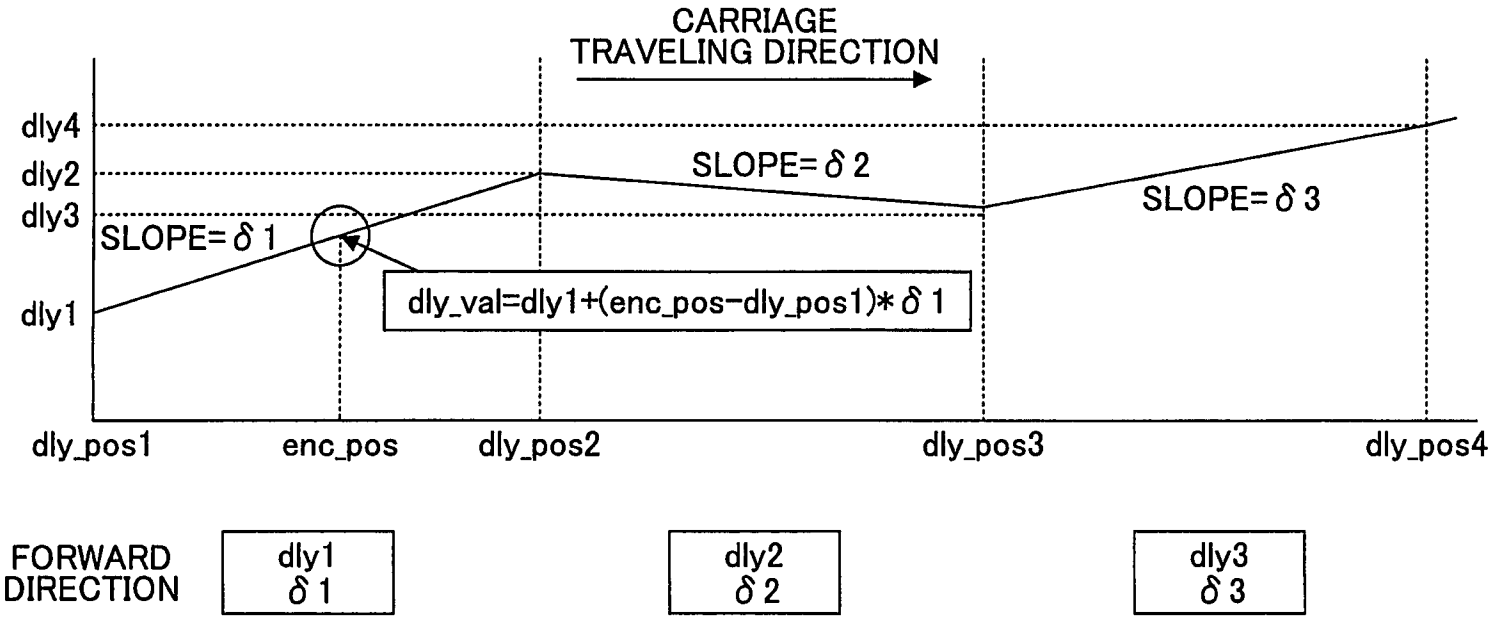
FIGS. 12A and 12B are diagrams illustrating an ejecting time adjusting value (dly_val) used at a desired scanning position (enc_pos)
Figure 12B:
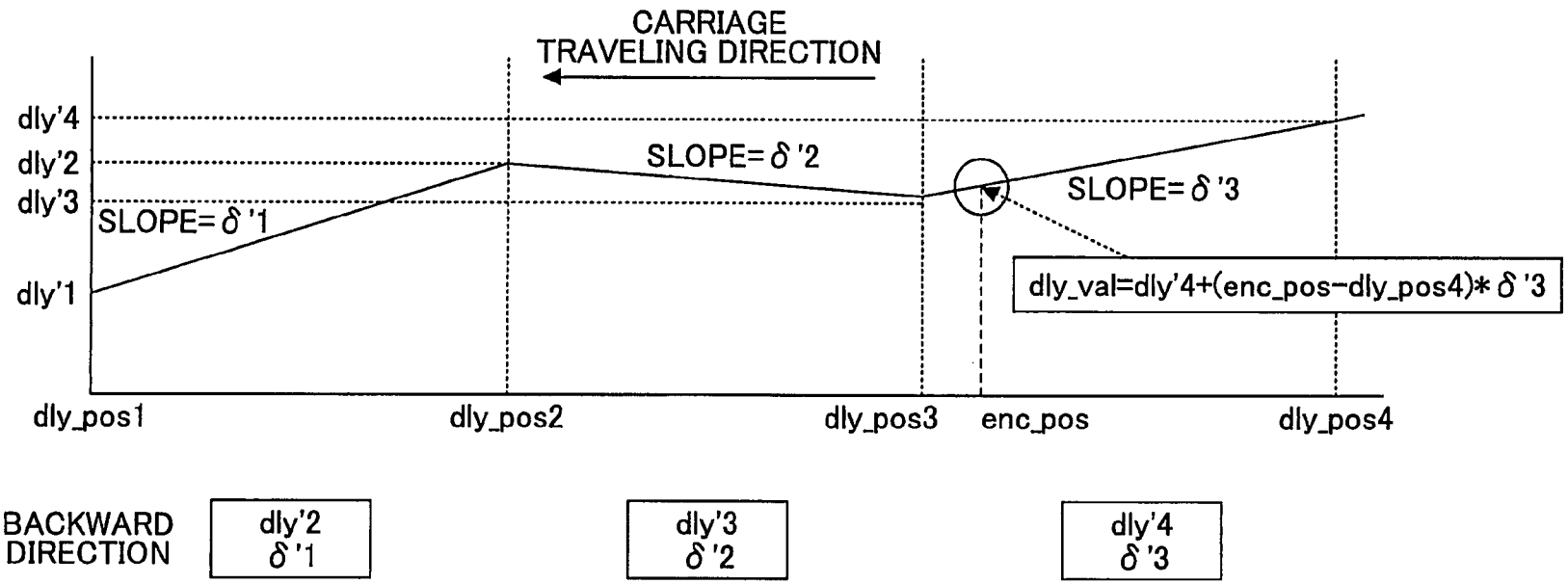
Figure 13:
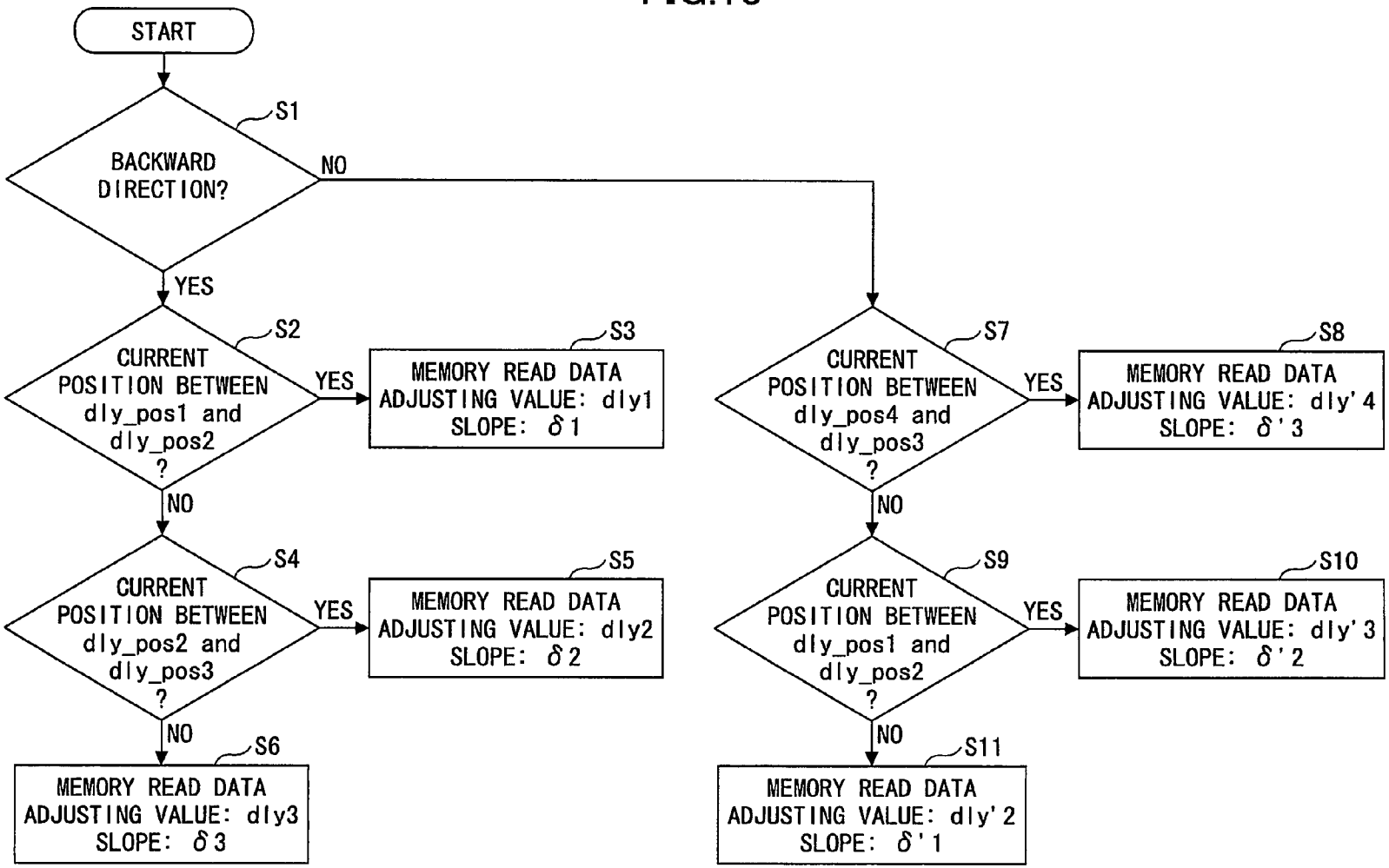
FIG. 13 is a diagram illustrating a process in which an ejecting time adjusting value (dly) and a slope (δ) are determined when the ejecting time adjusting value (dly_val) is computed.
Figure 14:
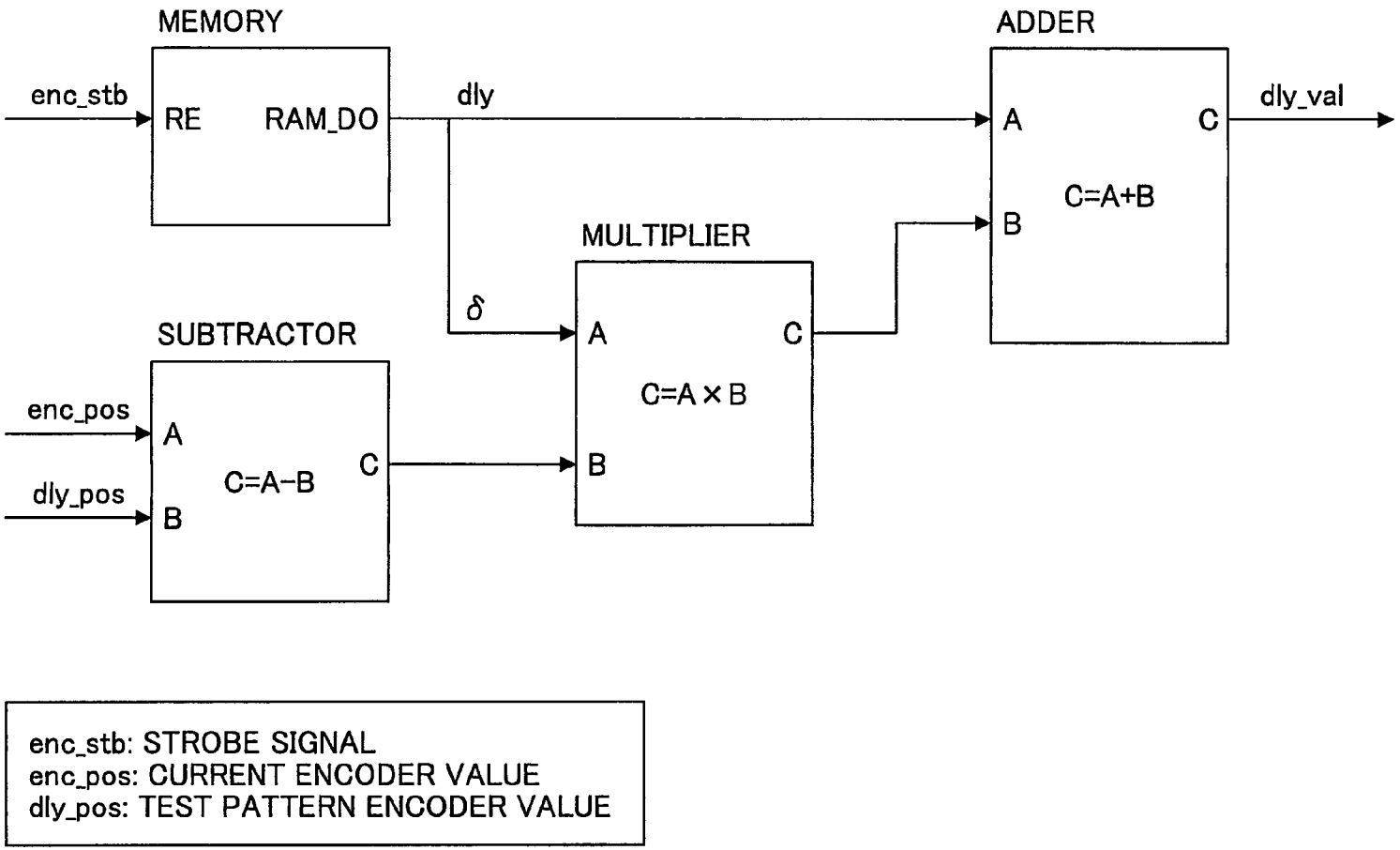
FIG. 14 is a configuration diagram illustrating an example of a calculator circuit to calculate the ejecting time adjusting value (dly_val) used at the desired scanning position (enc_pos)

Next, an ink ejecting time adjusting method for the recording head 6 is described with reference to FIGS. 11A through FIG. 14. Note that the number of plate-like members 300 is determined as N=4 in an example of the following description. FIGS. 11A and 11B are diagrams illustrating a relationship between encoder values (dly_pos1 to dly_pos4) of the test patterns 100 and ejecting time adjusting values (dly1 to dly4, dly'4 to dly'1). FIGS. 12A and 12B are diagrams illustrating an ejecting time adjusting value (dly_val) used at a desired scanning position (enc_pos). FIG. 13 is a diagram illustrating a process in which an ejecting time adjusting value (dly) and a slope (δ) are determined when the ejecting time adjusting value (dly_val) is computed. FIG. 14 is a configuration diagram illustrating an example of a calculator circuit to calculate the ejecting time adjusting value (dly_val) used at the desired scanning position (enc_pos). Note that the values shown in FIGS. 11A, 11B, 12A, and 12B are obtained when the platen 200 is composed of the mutually connected plate-like members 300 in the main-scanning direction.

In the recording apparatus according to the first embodiment, the user observes the recorded test patterns 100 with the naked eye and selects the optimal test pattern 100 having no print shifts from each of the transferring direction pattern arrays 103 recorded at the positions P1 through P6 (see FIG. 7) in the main-scanning direction. Accordingly, the optimal ink ejecting time adjusting value is obtained based on each of the transferring direction pattern arrays 103 recorded at the positions P1 through P6 on the recording medium 16. FIG. 11A illustrates ejecting time adjusting values (dly1 to dly4) when the carriage 5 is moved in the forward traveling direction. FIG. 11B illustrates ejecting time adjusting values (dly'4 to dly'1) when the carriage 5 is moved in the backward traveling direction.

The recording apparatus according to the first embodiment computes a slope δ between two adjacent test patterns 100 based on each of the ejecting time adjusting values (dly1 to dly4, dly'4 to dly'1) for the test patterns 100 and a corresponding one of the encoder values (dly_pos1 to dly_pos4) of the test patterns 100. For example, a slope δ between the first test pattern dly_pos1 and the second test pattern dly_pos2 is obtained by the following equation.

$$\delta 1=(dly2-dly1)/(dly_pos2-dly_pos1)$$

In the above equation, δ1 represents a slope between the first test pattern dly_pos1 and the second test pattern dly_pos2, dly2 represents an ejecting time adjusting value obtained for the second test pattern dly_pos2, dly1 represents an ejecting time adjusting value obtained for the first test pattern dly_pos1, dly_pos1 represents an encoder value for the first test pattern, and dly_pos2 represents an encoder value for the second test pattern.

The recording apparatus according to the first embodiment computes the slopes δ between the two adjacent test patterns 100, linearly interpolates between the ejecting time adjusting values dly1 to dly4 and dly'4 to dly'1 obtained from the test patterns 100 based on the obtained slopes δ and the ejecting time adjusting values dly1 to dly4 and dly'4 to dly'1, and controls ink ejecting times based on ejecting time adjusting values (dly_val) obtained by the linear interpolation between the ejecting time adjusting values dly1 to dly4 and dly'4 to dly'1, as illustrated in FIG. 12. Accordingly, it is possible to reduce the ink droplet shifts from the desired ones (ideal positions) on the recording medium 16 in the entire main-scanning direction when the relative distance between the platen 200 and the carriage 5 varies with the position of the carriage 5 in the main-scanning direction.

Note that the ejecting time adjusting value dly and the corresponding slope δ used when the ejecting time adjusting value (dly_val) is computed are determined by following the processing illustrated in FIG. 13.

As illustrated in FIG. 13, the CPU 107 determines whether a traveling direction of the carriage 5 is the forward traveling direction or the backward traveling direction (step S1). If the traveling direction of the carriage 5 is the forward traveling direction (Yes in step S1), the CPU 107 determines whether a current position (encoder value enc_pos) of the carriage 5 is between dly_pos1 and dly_pos2 (step S2).

If the current position (encoder value enc_pos) of the carriage 5 is between dly_pos1 and dly_pos2 (step S2), the CPU 107 employs an ejecting time adjusting value dly1 and a corresponding slope δ1 associated with dly_pos1 (step S3).

By contrast, if the current position (encoder value enc_pos) of the carriage 5 is not between dly_pos1 and dly_pos2 (No in step S2), the CPU 107 determines whether the current position (encoder value enc_pos) of the carriage 5 is between dly_pos2 and dly_pos3 (step S4).

If the current position (encoder value enc_pos) of the carriage 5 is between dly_pos2 and dly_pos3 (Yes in step S4), the CPU 107 employs an ejecting time adjusting value dly2 and a corresponding slope δ2 associated with dly_pos2 (step S5).

Further, if the current position (encoder value enc_pos) of the carriage 5 is not between dly_pos2 and dly_pos3 (No in step S4), the CPU 107 determines that the current position (encoder value enc_pos) of the carriage 5 is between dly_pos3 and dly_pos4 and employs an ejecting time adjusting value dly3 and a corresponding slope δ3 associated with dly_pos3 (step S6).

Meanwhile, if the traveling direction of the carriage 5 is the backward traveling direction (No in step S1), the CPU 107 determines whether the current position (i.e., encoder value enc_pos) of the carriage 5 is between dly_pos4 and dly_pos3 (step S7).

If the current position (encoder value enc_pos) of the carriage 5 is between dly_pos4 and dly_pos3 (Yes in step S7), the CPU 107 employs an ejecting time adjusting value dly'4 and a corresponding slope δ'3 associated with dly_pos4 (step S8).

By contrast, if the current position (encoder value enc_pos) of the carriage 5 is not between dly_pos4 and dly_pos3 (No in step S7), the CPU 107 determines whether the current position (encoder value enc_pos) of the carriage 5 is between dly_pos3 and dly_pos2 (step S9).

If the current position (encoder value enc_pos) of the carriage 5 is between dly_pos3 and dly_pos2 (Yes in step S9), the CPU 107 employs an ejecting time adjusting value dly'3 and a corresponding slope δ'2 associated with dly_pos3 (step S10).

Further, if the current position (encoder value enc_pos) of the carriage 5 is not between dly_pos3 and dly_pos2 (No in step S9), the CPU 107 determines that the current position (encoder value enc_pos) of the carriage 5 is between dly_pos2 and dly_pos1 and employs an ejecting time adjusting value dly'2 and a corresponding slope δ'1 associated with dly_pos2 (step S11). Thus, the CPU 107 can determine the ejecting time adjusting value dly and the corresponding slope δ based on the current position (encoder value enc_pos) of the carriage 5.

FIG. 14 illustrates a calculator circuit to calculate the ejecting time adjusting value (dly_val) used at a desired scanning position (enc_pos). As illustrated in FIG. 14, the calculator circuit includes a memory, a subtractor, a multiplier, and an adder.

The memory manages a correspondence table illustrated in FIG. 15 and refers to the correspondence table in order to output an appropriate ejecting time adjusting value dly and a corresponding slope δ based on the address information for every time a strobe signal enc_stb is input to the memory. The ejecting time adjusting value dly is output to the adder and the corresponding slope δ is output to the multiplier. The strobe signal enc_stb is obtained for every encoder cycle, and is obtained for every time the encoder value obtained by the encoder sensor 41 is changed by a predetermined value. For example, when the encoder value obtained by the encoder sensor 41 is changed from p1 to p2, the strobe signal enc_stb is input to the memory.

When the carriage 5 travels in a period between the positions dly_pos1 and dly_pos2 in the forward traveling direction, the memory refers to address information 1 and outputs the ejecting time adjusting value dly1 and the corresponding slope δ1 associated with dly_pos1 for the forward traveling direction. Further, when the carriage 5 travels in a period between the positions dly_pos2 and dly_pos3, the memory refers to address information 2 and outputs the ejecting time adjusting value dly2 and the corresponding slope δ2 associated with dly_pos2 for the forward traveling direction. Further, when the carriage 5 travels in a period between the positions dly_pos3 and dly_pos4, the memory refers to address information 3 and outputs the ejecting time adjusting value dly3 and the corresponding slope δ3 associated with dly_pos3 for the forward traveling direction.

By contrast, when the carriage 5 travels in a period between the positions dly_pos1 and dly_pos2 in the backward traveling direction, the memory refers to address information 4' and outputs the ejecting time adjusting value dly'4 and the corresponding slope δ'3 associated with dly_pos4 for the backward traveling direction. When the carriage 5 travels in a period between the positions dly_pos3 and dly_pos2, the memory refers to address information 3' and outputs the ejecting time adjusting value dly'3 and the corresponding slope δ'2 associated with dly_pos3 for the backward traveling direction. Further, when the carriage 5 travels in a period between the positions dly_pos2 and dly_pos1, the memory refers to address information 2' and outputs the ejecting time adjusting value dly'2 and the corresponding slope δ'1 associated with dly_pos2 for the backward traveling direction.

The subtractor computes the difference (enc_pos−dly_pos) between the positions enc_pos and dly_pos input thereto and the computed difference (enc_pos−dly_pos) to the multiplier. Note that the position enc_pos indicates the current position (i.e., encoder value) of the carriage 5, and the position dly_pos indicates the encoder value of the test pattern 100. For example, the positions dly_pos1, dly_pos2, and dly_pos3 represent the respective encoder values of the first, second, and third test patterns 100.

The multiplier multiplies the slope δ input from the memory by the difference (enc_pos−dly_pos) input from the subtractor to compute the product (multiplied value), which is output to the adder.

The multiplier multiplies the slope δ input from the memory by the difference (enc_pos−dly_pos) input from the subtractor to compute the product dly_val (i.e., multiplied value), which is output to the adder. The multiplied value dly_val indicates an ink ejecting time adjusting value for actually printing the test pattern 100 on the recording medium 16.

Note that in this embodiment, the multiplied value del_val is computed by the calculator circuit; however, the value del_val may be computed by a computer program that can obtain the value del_val computed by the calculator circuit.

[Reduction in Print Shifts]

Next, a process for reducing print shifts by linearly interpolating between the ink ejecting time adjusting values is described.

Figure 16:
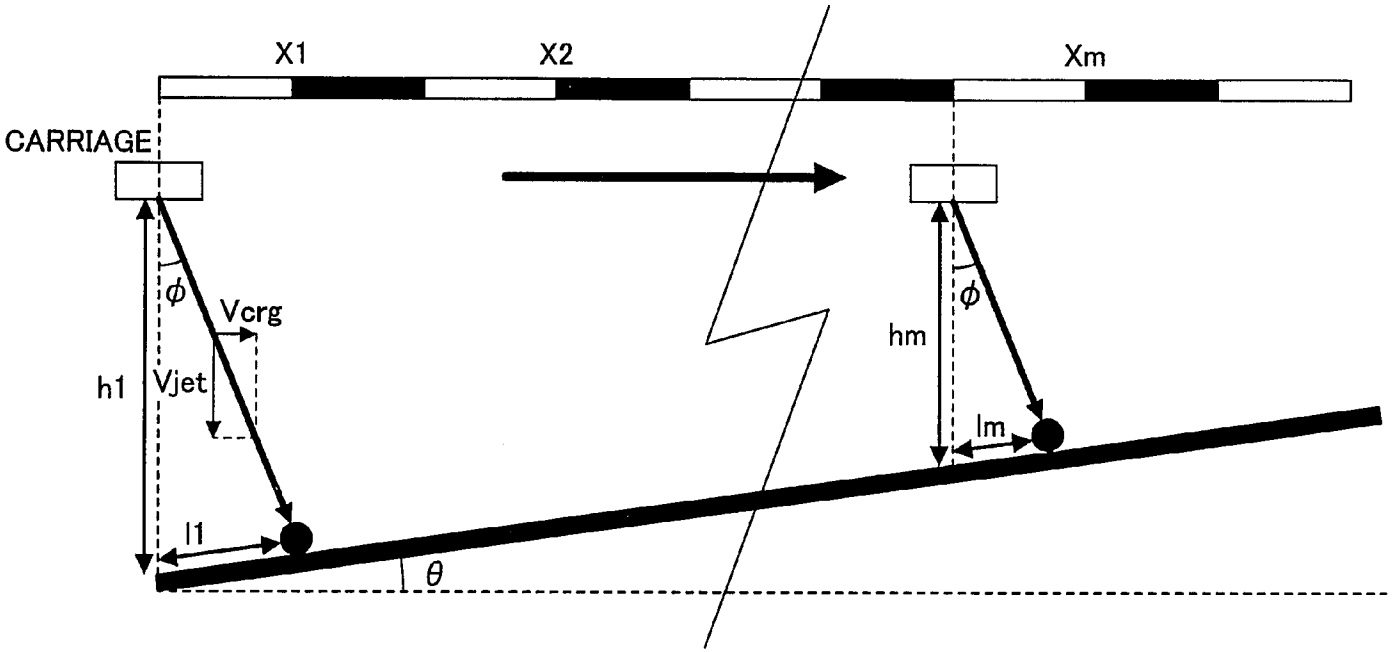
FIG. 16 is a first diagram illustrating a process in which shifts in inkjet printing are reduced.

As illustrated in FIG. 16, the difference of the ink ejecting distance when the platen 200 is tilted at θ degrees is initially computed.

FIG. 16 illustrates the following relationship:

$$\tan\theta=(h1-hm)/(xm-x1),\text{ which results in } hm=h1-(xm-x1)\tan\theta \quad (1)$$

Figure 17:
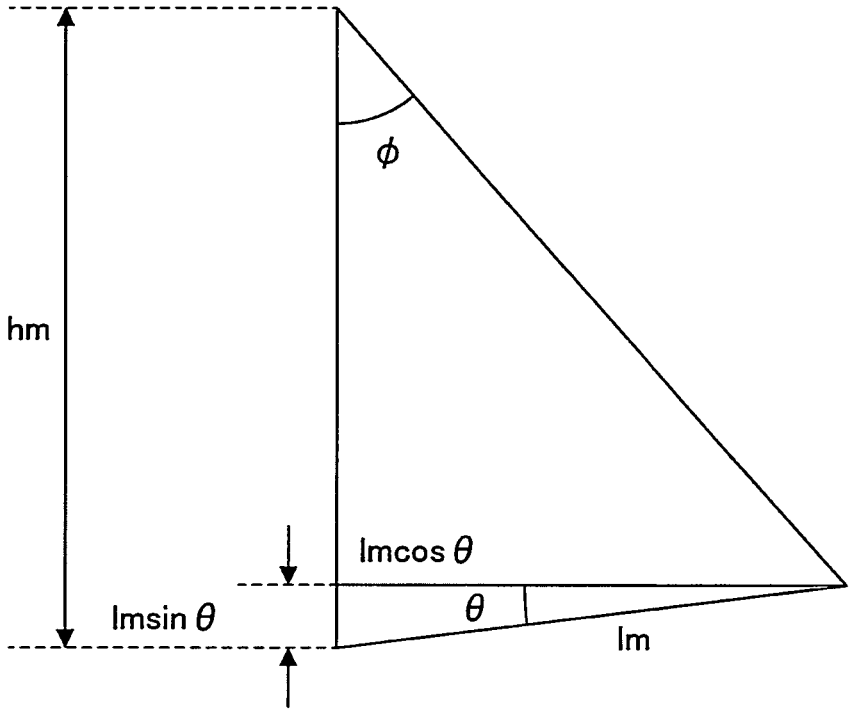
FIG. 17 is a second diagram illustrating a process in which shifts in inkjet printing are reduced.

Further, FIG. 17 indicates the following relationship:

$$\tan\phi=1m\cos\theta/(hm-1m\sin\theta),\text{ which results in } 1m=hm\tan\phi/(\cos\theta+\tan\phi\sin\theta) \quad (2)$$

By substituting the formula (1) into the formula (2), the following equation is obtained.

$$1m=(h1-(xm-x1)\tan\theta)\tan\phi/(\cos\theta+\tan\phi\sin\theta)$$

When the above equation is replaced by the following A and B:

$$A=-\tan\theta\tan\phi/(\cos\theta+\tan\phi\sin\theta);\text{ and}$$

$$B=h1\tan\phi/(\cos\theta+\tan\phi\sin\theta),\text{ the following equation is obtained.}$$

$$1m=A(xm-x1)+B\text{ (wherein } A\text{, and } B\text{ are a constant number)} \quad (3)$$

From the above equation, the ink ejection distance is changed when the platen 200 is tilted based on linear function of the traveled amount of the carriage 5.

Figure 18:
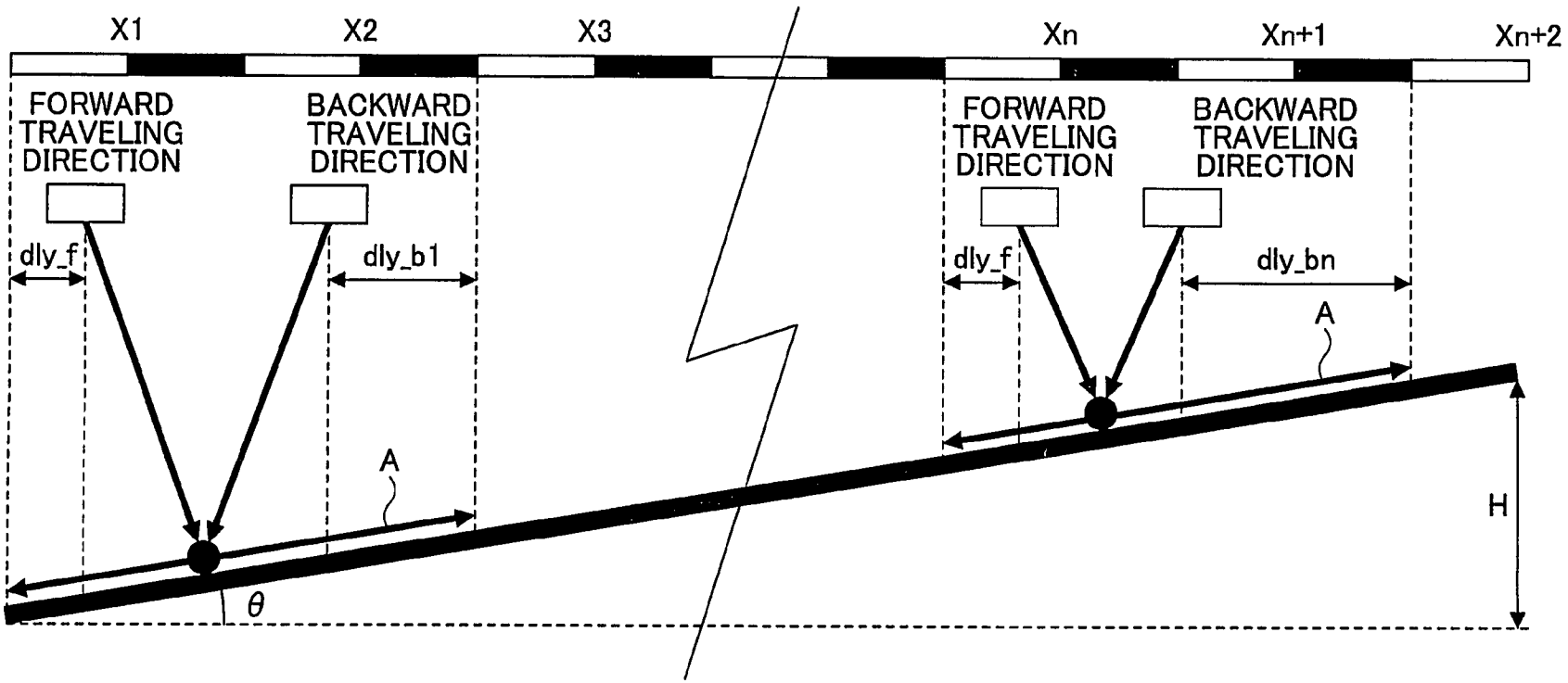
FIG. 18 is a third diagram illustrating a process in which shifts in inkjet printing are reduced.

Next, how the ink ejecting time is controlled while printing in the backward traveling direction is examined when the ink ejecting time while printing in the forward traveling direction is constant. Note that the ink ejecting time for printing in the backward traveling direction is delayed from the ink ejecting time for printing in the forward traveling direction based on a position at which two encoder cycles have been completed, as illustrated in FIG. 18.

Then, based on the fact that the two lengths "A" are both the same length, the above equation (3), the following equation (4) is obtained.

$$dly_f/\cos\theta+A(x1-x1+dly_f)+B+A'(x3-x1-dly_b1)+B'+dly_b1/\cos\theta=dly_f/\cos\theta+A(xn-x1+dly_f)+B+A'(xn+2-x1-dly_bn)+B'+dly_bn/\cos\theta \quad (4)$$

From the above equation (3), the following A' and B' are obtained.

$$A'=-\tan\theta\tan\phi/(\cos\theta-\tan\phi\sin\theta)$$

$$B'=h1\tan\phi/(\cos\theta-\tan\phi\sin\theta)$$

In summarizing the equation (4), the following equation is obtained.

$$0=A(xn-x1)+A'(xn+2-x3)+dly_bn(1/\cos\theta-A')-dly_b1(1/\cos\theta-A')$$

Further, the above is rearranged based on "xn−x1=xn+2−x3", the following equation is obtained.

$$dn=d1-(A+A')(xn-x1)/(1/\cos\theta-A'),\text{ wherein } dn \text{ represents } dly_bn,\text{ and } d1 \text{ represents } dly_b1.$$

When the above equation is replaced by the equation C=−(A+A')/(1/cos θ−A'), the following equation is obtained.

$$dn=d1+(xn-x1)C \quad (5)$$

From the equation (5), the optional integer m that satisfies the condition 1≦m≦n is obtained by the following equation.

$$dm=d1+(xm-x1)*(dn-d1)/(xn-x1) \quad (6)$$

The relationship expressed by the above equation (6) illustrated in FIG. 19.

As illustrated in FIG. 19, the print shifts obtained in printing forward and backward traveling directions due to tilting of the platen 200 may be reduced by linearly changing the delay in printing in the backward traveling direction, when the delay in printing in the forward traveling direction is constant.

Note that in the above example, the ink ejecting time is controlled such that the ink is ejected in printing in the backward traveling direction after the carriage 5 has traveled two encoder cycles. However, as can be clear from the equation (3), the ink ejecting time is not limited to the time after the carriage has traveled two encoder cycles.

[Interaction and Effect of Recording Apparatus]

As described above, the recording apparatus according to the first embodiment records the test patterns 100, the number of which corresponds to the number of plate-like members 300 forming the platen 200, in the main-scanning direction (carriage traveling direction) on the recording medium 16 supported by the platen 200, and determines the ink ejecting time adjusting values at the positions where the test patterns 100 are recorded on the recording medium 16. The recording apparatus according to the first embodiment then linearly interpolates between the ink ejecting time adjusting values determined based on the test patterns 100, the ink ejecting times are controlled based on ejecting time adjusting values obtained by the linear interpolation between the ink ejecting time adjusting values.

Accordingly, in the recording apparatus according to the first embodiment including the platen 200 composed of the plural plate-like members 300 connected in the main-scanning direction (carriage traveling direction), it is possible to reduce the ink droplet shifts obtained due to the changes in relative distances between the plural plate-like members 300 of the platen 200 and the carriage 5 in the main-scanning direction.

Second Embodiment

Next, a recording apparatus according to a second embodiment is described.

As illustrated in FIG. 4, the recording apparatus according to the first embodiment, the test patterns 100 are recorded at the positions of the recording medium 16 corresponding to both end portions of the platen 200 and at the positions of the recording medium 16 corresponding to connecting portions of the plate-like members 300 connected in the main-scanning direction.

Figure 20:
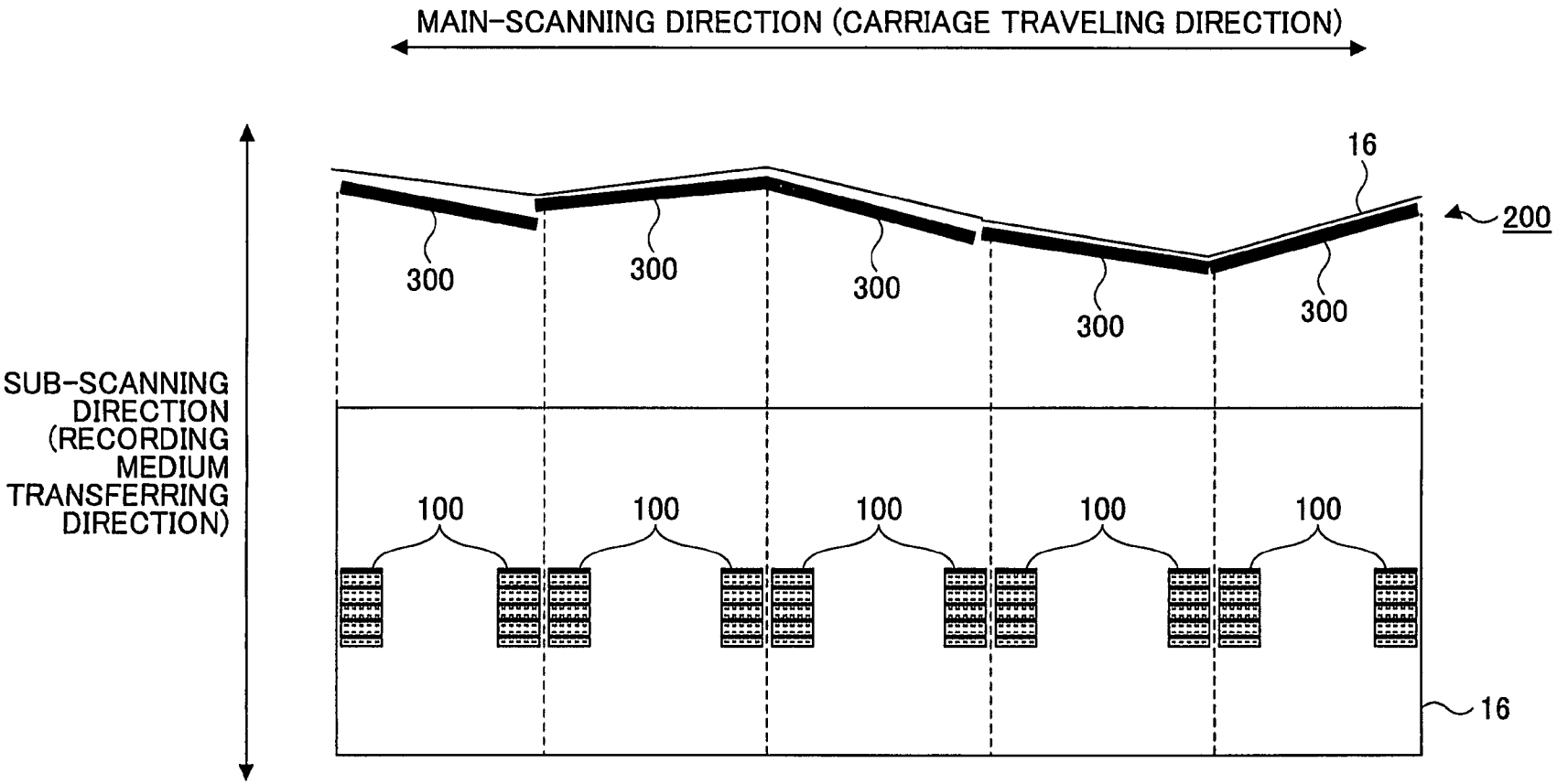
FIG. 20 is a configuration diagram illustrating a platen 200 composed of plate-like members 300 and test patterns 100 in a recording apparatus according to a second embodiment.

However, as illustrated in FIG. 20, in the recording apparatus according to the second embodiment, the test patterns 100 are recorded at the positions of the recording medium 16 corresponding to both end portions of the plate-like members 300 connected in the main-scanning direction to form the platen 200. In the second embodiment, if the number of plate-like members 300 forming the platen 200 is supposed to be N, the number of test patterns 100 to be recorded on the recording medium 16 is obtained by N*2. In FIG. 20, since five plate-like members 300 are connected to form the platen 200, the number of end portions of the connected plate-like members 300 is ten. Accordingly, there are a total number of 10 positions on the recording medium 16 at which the test patterns 100 are to be recorded. In the recording apparatus according to the second embodiment, since the ink ejecting times are adjusted in the same manner as those of the first embodiment, it is possible to reduce the ink droplet shifts obtained due to the changes in relative distances between the plural plate-like members 300 of the platen 200 and the carriage 5 in the main-scanning direction.

Third Embodiment

Next, a recording apparatus according to a third embodiment is described.

Figure 21:
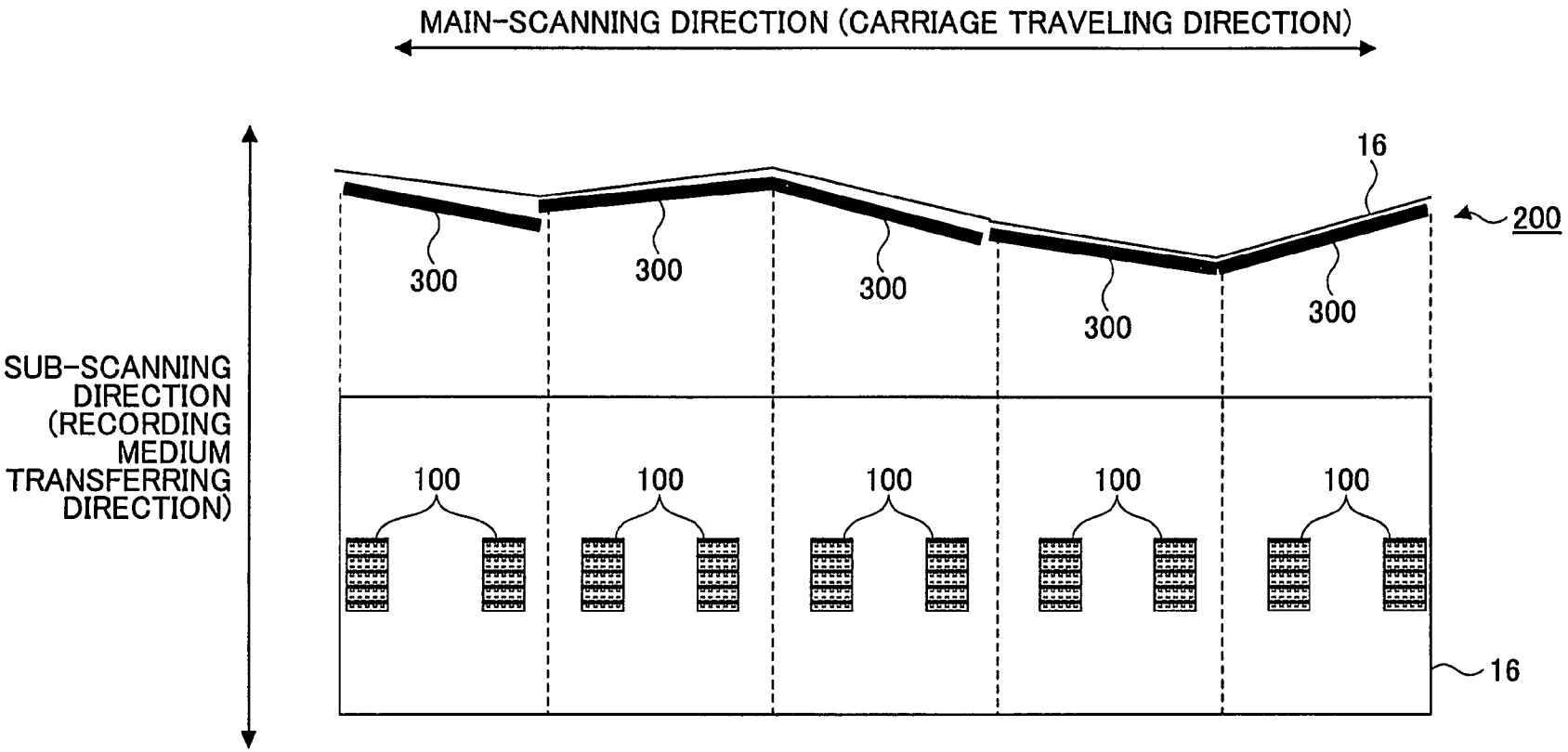
FIG. 21 is a configuration diagram illustrating a platen 200 composed of plate-like members 300 and test patterns 100 in a recording apparatus according to a third embodiment.

As illustrated in FIG. 21, in the recording apparatus according to the third embodiment, the test patterns 21 are recorded at two arbitrary positions of the recording medium 16 corresponding to each of the plate-like members 300 connected in the main-scanning direction to form the platen 200. In the third embodiment, if the number of plate-like members 300 forming the platen 200 is supposed to be N, the number of test patterns 100 to be recorded on the recording medium 16 is obtained by N*2. As illustrated in FIG, 21, since five plate-like members 300 are connected to form the platen 200, the number of arbitrary positions of the recording medium 16 corresponding to the surfaces of the connected plate-like members 300 is ten. Accordingly, there are a total number of 10 positions on the recording medium 16 at which the test patterns 100 are to be recorded.

Figure 22A:
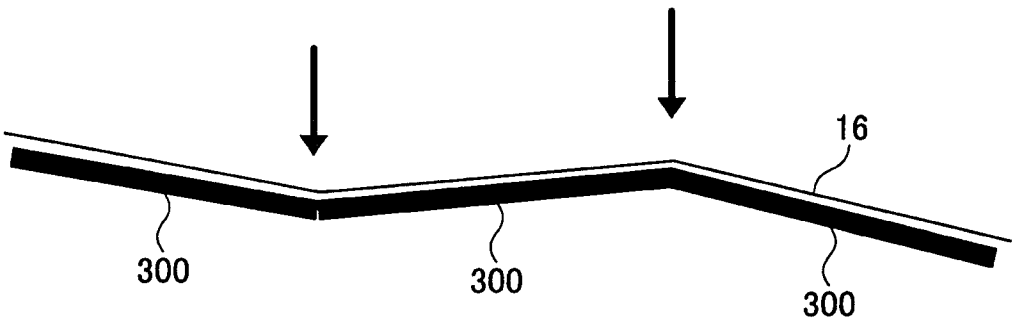
FIGS. 22A and 22B are configuration diagrams illustrating the platen 200 composed of the plate-like members 300 and recording media 16 in the recording apparatus according to the third embodiment.
Figure 22B:
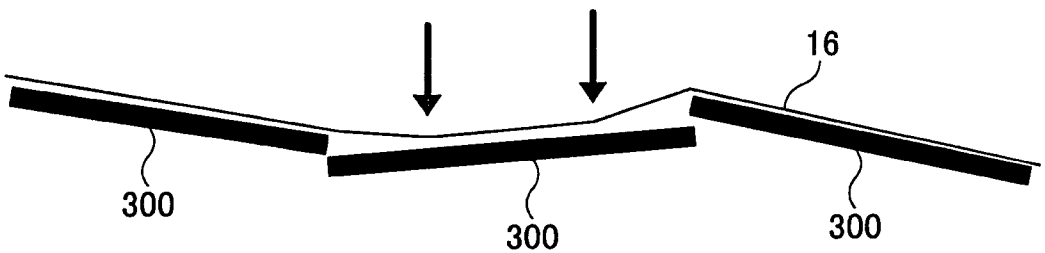

As illustrated in FIG. 22A, if the connecting portions of the platen 200 are continuous in a height direction of the platen 200, a slope of the recording medium 16 is changed at one position corresponding to one connection portion of the plate-like member 300 indicated by arrows regardless of types of the recording medium 16. However, as illustrated in FIG. 22B, if the connecting portions of the platen 200 are discontinuous in a height direction of the platen 200, a slope of the recording medium 16 is changed at two positions corresponding to one connecting portion of the plate-like member 300 indicated by arrows.

Accordingly, as illustrated in FIG. 21, in the recording apparatus according to the third embodiment, the test patterns 21 are recorded at two arbitrary positions of the recording medium 16 corresponding to each of the plate-like members 300 connected in the main-scanning direction to form the platen 200, and linear interpolation between the ink ejecting time adjusting values obtained from the test patterns 100 are obtained. Thus, it is possible to reduce the ink droplet shifts from the desired ones (ideal positions) on the recording medium 16 when the relative distance between the platen 200 and the carriage 5 varies with the position of the carriage 5 in the main-scanning direction.

Fourth Embodiment

Next, a recording apparatus according to a fourth embodiment is described.

In the recording apparatus according to the fourth embodiment, two arbitrary positions of the recording medium 16 where the test patterns 100 are recorded based on the types of the recording medium 16 supporting the platen 200.

Figure 23A:
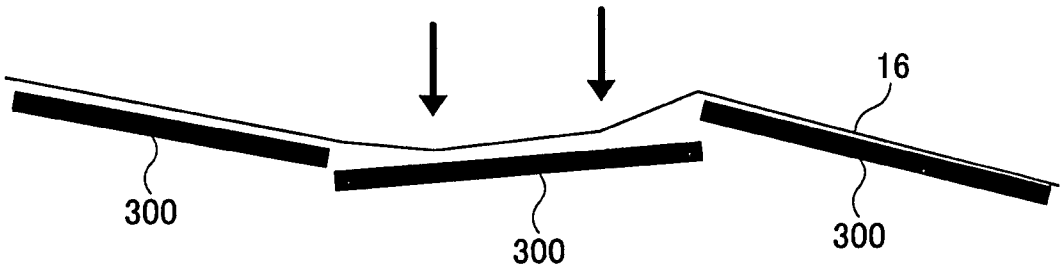
FIGS. 23A and 23B are configuration diagrams illustrating a platen 200 composed of plate-like members 300 and recording media 16 in a recording apparatus according to a fourth embodiment.
Figure 23B:
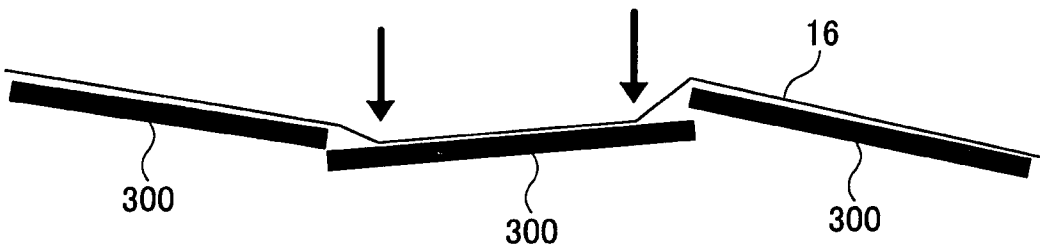

Similar to the third embodiment, if the connecting portions of the platen 200 are discontinuous in a height direction of the platen 200, a change position of the slope of the recording medium 16 are determined based on the rigidity of the recording medium 16. That is, if the recording medium 16 has a high rigidity, the change position of the slope of the recording medium 16 comes to a position having longer distance from the connecting portion of the plate-like members 300 as illustrated in FIG. 23A. If, on the other hand, the recording medium 16 has a low rigidity, the change position of the slope of the recording medium 16 comes to a position having shorter distance from the connecting portion of the plate-like members 300 as illustrated in FIG. 23B.

Accordingly, in the recording apparatus according to the fourth embodiment, the test patterns 100 are recorded at two arbitrary positions of the recording medium 16 that are adjusted based on the types of the recording medium 16, and linear interpolation between the ink ejecting time adjusting values obtained from the test patterns 100 are obtained. In this case, a correspondence table including the types of the recording medium 16 and the ink ejecting adjusting values based on the types of the recording medium 16 is managed in advance from which the ink ejecting time adjusting values corresponding to the types of the recording medium 16 are retrieved. Accordingly, two arbitrary positions on the recording medium 16 are adjusted based on the ink ejecting time adjusting values based on the types of the recording medium 16 is retrieved from the correspondence table to thereby record the test patterns 100 on the corresponding recording medium 16. In this manner, the print shifts may be reduced regardless of the types of the recording medium 16.

Note that the above-described embodiments are only the preferred embodiments of the invention, which should not be construed as limitation of the scope of the present invention. Various variations and modifications may be made without departing from the scope of the present invention.

For example, control operations of the components of the recording apparatus according to the embodiments may be achieved by hardware, software, or a combination of hardware and software.

If the control operations of the recording apparatus are achieved by the software, the control operations are achieved by executing computer programs composed of processing sequences that are installed in the memory incorporated in a computer of special-purpose hardware. Alternatively, the control operations are achieved by executing such computer programs installed in a general-purpose computer that is capable of executing various types of processing.

For example, the computer programs may be recorded in advance in hardware such as a recording medium or a Read-only memory (ROM). Alternatively, the computer programs may be recorded or stored temporarily or permanently a removable recording medium. Such removable recording medium may be provided as a software package. Note that examples of the removable recording medium include a floppy (Registered Trademark) disk, a compact disc read only memory (CD-ROM), a magneto-optical (MO) disk, a digital versatile disc (DVD), a magnetic disk, and a semiconductor memory.

Note that the above-described computer programs may be installed in the computer via such a removable recording medium. Alternatively, the above-described computer programs may be wirelessly transferred in the computer via the download site. Or, the above-described computer programs may be transferred by wire in the computer via the network.

Note also that the recording apparatus according to the embodiments may configured such that the processing operations are not only carried out in time series but are also carried out individually or in parallel.

The recording apparatus according to the above-described embodiments are suitable for ink-jet printers.

The recording apparatus according to the above-described embodiments including the platen 200 composed of the plural plate-like members 300 connected in the main-scanning direction (carriage traveling direction) is capable of reducing the ink droplet shifts obtained due to the changes in relative distances between the plural plate-like members forming the platen and the carriage 5 in the main-scanning direction.

Embodiments of the present invention have been described heretofore for the purpose of illustration. The present invention is not limited to these embodiments, but various variations and modifications may be made without departing from the scope of the present invention. The present invention should not be interpreted as being limited to the embodiments that are described in the specification and illustrated in the drawings.

The present application is based on Japanese priority applications No. 2009-212280 filed on Sep. 14, 2009, with the Japanese Patent Office, the entire contents of which are hereby incorporated by reference.

What is claimed is:

1. A recording apparatus comprising:

a carriage having a recording head including plural nozzles for ejecting ink;

a moving unit configured to move the carriage having the recording head including the plural nozzles for ejecting ink;

a platen including plural plate members connected in a carriage traveling direction and configured to support a recording medium when the plural nozzles of the carriage eject ink onto the recording medium;

a transferring unit configured to transfer the recording medium in a direction perpendicular to the carriage traveling direction;

a recording control unit configured to record patterns, the number of which corresponds to a number of the plate members, at set plural positions in the carriage traveling direction on a surface of the recording medium supported by the platen to form a carriage traveling direction pattern array while moving the carriage in forward and backward traveling directions, and record the carriage traveling direction pattern array plural times in a transferring direction of the transferring unit by changing relative recording times for recording the carriage traveling direction pattern array in forward and backward traveling directions to form plural transferring direction pattern arrays in the transferring direction of the transferring unit such that a pattern group including a group of the patterns is obtained;

a determination unit configured to determine ink ejecting times at the set plural positions in the carriage traveling direction on a surface of the recording medium by selecting an optimal pattern from each of the plural transferring direction pattern arrays recorded at the set plural positions in the carriage traveling direction on the surface of the recording medium; and a time control unit configured to linearly interpolate between the determined ink ejecting times at the set plural positions in the carriage traveling direction on the surface of the recording medium so as to control ink ejecting times for respective intervals between the set plural positions in the carriage traveling direction on the surface of the recording medium based on the linear interpolation between the determined ink ejecting times at the set plural positions in the carriage traveling direction.

2. The recording apparatus as claimed in claim 1, wherein the time control unit manages the ink ejecting times determined at the set plural positions associated with the corresponding set plural positions, and linearly interpolates between a first ink ejecting time associated with a first position and a second ink ejecting time associated with a second position so as to control the ink ejecting time for an interval between the first position and the second position based on an ink ejecting time between the first ink ejecting time and the second ink ejecting time obtained by the linear interpolation between the first ink ejecting time and the second ink ejecting time.

3. The recording apparatus as claimed in claim 1, wherein the set plural positions correspond to both end portions of the platen and connecting portions of the plate members that forms the platen.

4. The recording apparatus as claimed in claim 1, wherein the set plural positions correspond to both end portions of each of the plate members that form the platen.

5. The recording apparatus as claimed in claim 1, wherein the set plural positions correspond to two arbitrary positions of each of the plate members that form the platen.

6. The recording apparatus as claimed in claim 5, wherein the recording control unit adjusts the two arbitrary positions of each of the plate members that form the platen based on types of the recording medium supported by the platen.

7. A method for controlling a recording apparatus including a carriage having a recording head including plural nozzles for ejecting ink, a moving unit configured to move the carriage having the recording head including the plural nozzles for ejecting ink, a platen including plural plate members connected in a carriage traveling direction and configured to support a recording medium when the plural nozzles of the carriage eject ink onto the recording medium, and a transferring unit configured to transfer the recording medium in a direction perpendicular to the carriage traveling direction, the method comprising:

recording patterns, the number of which corresponds to a number of the plate members, at set plural positions in the carriage traveling direction on a surface of the recording medium supported by the platen to form a carriage traveling direction pattern array while moving the carriage in forward and backward traveling directions, and recording the carriage traveling direction pattern array plural times in a transferring direction of the transferring unit by changing relative recording times for recording the carriage traveling direction pattern array in forward and backward traveling directions to form plural transferring direction pattern arrays in the transferring direction of the transferring unit such that a pattern group including a group of the patterns is obtained;

determining ink ejecting times at the set plural positions in the carriage traveling direction on a surface of the recording medium by selecting an optimal pattern from each of the plural transferring direction pattern arrays recorded at the set plural positions in the carriage traveling direction on the surface of the recording medium; and linearly interpolating between the determined ink ejecting times at the set plural positions in the carriage traveling direction on the surface of the recording medium so as to control ink ejecting times for respective intervals between the set plural positions in the carriage traveling direction on the surface of the recording medium based on the linear interpolation between the determined ink ejecting times at the set plural positions in the carriage traveling direction.

8. The method as claimed in claim 7, wherein linearly interpolating between the determined ink ejecting times at the set plural positions is associated with the corresponding set plural positions, which linearly interpolates between a first ink ejecting time associated with a first position and a second ink ejecting time associated with a second position so as to control the ink ejecting time for an interval between the first position and the second position based on an ink ejecting time between the first ink ejecting time and the second ink ejecting time obtained by the linear interpolation between the first ink ejecting time and the second ink ejecting time.

9. The method as claimed in claim 7, wherein the set plural positions correspond to both end portions of the platen and connecting portions of the plate members that forms the platen.

10. The method as claimed in claim 7, wherein the set plural positions correspond to both end portions of each of the plate members that form the platen.

11. The method as claimed in claim 7, wherein the set plural positions correspond to two arbitrary positions of each of the plate members that form the platen.

12. The method as claimed in claim 11, wherein the recording control unit adjusts the two arbitrary positions of each of the plate members that form the platen based on types of the recording medium supported by the platen.

13. A recording apparatus, comprising:

a carriage having a recording head including plural nozzles for ejecting ink;

a moving unit configured to move the carriage having the recording head including the plural nozzles for ejecting ink;

a platen including plural plate members connected in a carriage traveling direction and configured to support a recording medium when the plural nozzles of the carriage eject ink onto the recording medium;

a transferring unit configured to transfer the recording medium in a direction perpendicular to the carriage traveling direction;

a recording control unit configured to record patterns, the number of which corresponds to a number of the plate members, at set plural positions in the carriage traveling direction on a surface of the recording medium supported by the platen to form a carriage traveling direction pattern array while moving the carriage in forward and backward traveling directions, and record the carriage traveling direction pattern array plural times in a transferring direction of the transferring unit by changing relative recording times for recording the carriage traveling direction pattern array in forward and backward traveling directions to form plural transferring direction pattern arrays in the transferring direction of the transferring unit such that a pattern group including a group of the patterns is obtained;

a determination unit configured to determine ink ejecting times at the set plural positions in the carriage traveling direction on a surface of the recording medium based on a setting of a receiving unit, the setting being associated with an optimal pattern from each of the plural transferring direction pattern arrays recorded at the set plural positions in the carriage traveling direction on the surface of the recording medium; and a time control unit configured to linearly interpolate between the determined ink ejecting times at the set plural positions in the carriage traveling direction on the surface of the recording medium so as to control ink ejecting times for respective intervals between the set plural positions in the carriage traveling direction on the surface of the recording medium based on the linear interpolation between the determined ink ejecting times at the set plural positions in the carriage traveling direction.

14. The recording apparatus as claimed in claim 13, wherein the time control unit manages the ink ejecting times determined at the set plural positions associated with the corresponding set plural positions, and linearly interpolates between a first ink ejecting time associated with a first position and a second ink ejecting time associated with a second position so as to control the ink ejecting time for an interval between the first position and the second position based on an ink ejecting time between the first ink ejecting time and the second ink ejecting time obtained by the linear interpolation between the first ink ejecting time and the second ink ejecting time.

15. The recording apparatus as claimed in claim 13, wherein the set plural positions correspond to both end portions of the platen and connecting portions of the plate members that forms the platen.

16. The recording apparatus as claimed in claim 13, wherein the set plural positions correspond to both end portions of each of the plate members that form the platen.

17. The recording apparatus as claimed in claim 13, wherein the set plural positions correspond to two arbitrary positions of each of the plate members that form the platen.

18. The recording apparatus as claimed in claim 17, wherein the recording control unit adjusts the two arbitrary positions of each of the plate members that form the platen based on types of the recording medium supported by the platen.

* * * * *